US011462336B2

(12) United States Patent
Kamen

(10) Patent No.: US 11,462,336 B2
(45) Date of Patent: Oct. 4, 2022

(54) BIOHAZARDOUS MATERIAL TRANSPORTING PIG

(71) Applicant: Robert Kamen, Toronto (CA)

(72) Inventor: Robert Kamen, Toronto (CA)

( * ) Notice: Subject to any disclaimer, the term of this patent is extended or adjusted under 35 U.S.C. 154(b) by 388 days.

(21) Appl. No.: 16/479,590

(22) PCT Filed: Jun. 6, 2017

(86) PCT No.: PCT/CA2017/050689
§ 371 (c)(1),
(2) Date: Jul. 20, 2019

(87) PCT Pub. No.: WO2018/132891
PCT Pub. Date: Jul. 26, 2018

(65) Prior Publication Data
US 2019/0348187 A1 Nov. 14, 2019

(51) Int. Cl.
*G21F 5/12* (2006.01)
*A61J 1/16* (2006.01)
(Continued)

(52) U.S. Cl.
CPC ..... *G21F 5/12* (2013.01); *A61J 1/16* (2013.01); *B65D 77/0493* (2013.01);
(Continued)

(58) Field of Classification Search
CPC ... G21F 5/12; G21F 5/015; G21F 5/14; B65D 77/0493; B65D 85/70; A61J 1/16
(Continued)

(56) References Cited

U.S. PATENT DOCUMENTS 541,855 A * 7/1895 Hickson ..... A47G 23/0216 220/737
2,734,358 A * 2/1956 Himmelfarb ..... F25D 3/08 220/23.87

(Continued)

FOREIGN PATENT DOCUMENTS

| | | | |
|---|---|---|---|
| EP | 2216265 | A1 | 11/2010 |
| WO | 2009000455 | A1 | 12/2008 |
| WO | 2018132891 | A1 | 7/2018 |

OTHER PUBLICATIONS

International Search Report, dated Sep. 28, 2017, for PCT Application No. PCT/CA2017/050689, International Filing Date Jun. 6, 2017, consisting of 4 pages.

(Continued)

*Primary Examiner* — J. Gregory Pickett
*Assistant Examiner* — Niki M Eloshway

(57) ABSTRACT

A pig for transporting a container of biohazardous material, wherein the container comprises a bottle and a bottle closure. The pig includes a body comprising a compartment dimensioned to receive the container; a cap attachable to the body for closing the compartment thereby to shieldingly contain the biohazardous material in the container, the cap including: a collar sealingly engageable with the body and having an opening therethrough in communication with the compartment thereby to provide access to the bottle closure; a cap closure sealingly engageable within the opening of the collar to sealingly close the opening and cause the bottle closure to be gripped within the cap, wherein when the collar is disengaged from the body while the cap closure is engaged within the opening of the collar, the container remains gripped within the cap. A system for transporting and providing access to a biohazardous material includes the pig and an insert sealingly engageable within the opening of the collar while the cap closure is removed, the insert (Continued)

comprising an injection port extending fully therethrough in axial alignment with the compartment thereby to guide insertion of a syringe centrally through the container closure and into the container. A compression member for insertion into a pig for transporting a container of biohazardous materials is also provided. The compression member includes a flange; and spaced apart fingers supported by the flange and together forming a circle, the fingers each having a substantially vertical component extending upwards from the flange and a substantially horizontal component extending inwards from an end of the substantially vertical component distal from the flange, the spaced apart fingers resiliently compressible inwardly against the container by compressive engagement of a complementary annulus of the pig into which the compression member is dimensioned to be inserted.

20 Claims, 21 Drawing Sheets

(51) Int. Cl.
*B65D 77/04* (2006.01)
*B65D 85/00* (2006.01)
*G21F 5/015* (2006.01)
*G21F 5/14* (2006.01)

(52) U.S. Cl.
CPC ..... *B65D 85/70* (2013.01); *G21F 5/015* (2013.01); *G21F 5/14* (2013.01)

(58) Field of Classification Search
USPC ..... 220/522, 506, 758, 762, 759
See application file for complete search history.

(56) References Cited

U.S. PATENT DOCUMENTS

| | | | | |
|---|---|---|---|---|
| 3,971,955 | A | 7/1976 | Heyer | |
| 4,842,158 | A * | 6/1989 | Reyes, Jr. | B65D 23/106 215/392 |
| 5,044,514 | A * | 9/1991 | Portat | B65D 11/06 220/23.87 |
| 5,927,351 | A | 7/1999 | Zhu | |
| 7,615,513 | B2 * | 11/2009 | Guckel | C07C 51/313 502/350 |
| 8,777,031 | B2 | 7/2014 | Aneas | |
| 2007/0108205 | A1 | 5/2007 | Porras | |
| 2011/0000872 | A1 * | 1/2011 | Aneas | B65D 51/241 215/273 |
| 2014/0034646 | A1 | 2/2014 | Lanier | |
| 2014/0042050 | A1 * | 2/2014 | Richart | A61F 2/0095 206/438 |
| 2014/0263319 | A1 | 9/2014 | Fazi et al. | |
| 2016/0030286 | A1 | 2/2016 | Fazi | |
| 2016/0194121 | A1 | 7/2016 | Ogawa et al. | |
| 2019/0348187 | A1 * | 11/2019 | Kamen | A61J 1/16 |
| 2021/0005337 | A1 * | 1/2021 | Kamen | G21F 5/12 |

OTHER PUBLICATIONS

International Preliminary Report on Patentability, dated Jul. 23, 2019, for PCT Application No. PCT/CA2017/050689, International Filing Date Jun. 6, 2017, consisting of 6 pages.
Written Opinion of the International Searching Authority, dated Sep. 28, 2017, for PCT Application No. PCT/CA2017/050689, International Filing Date Jun. 6, 2017, consisting of 5 pages.
Extended European Search Report dated Oct. 9, 2020 issued in PCT/CA2017/050689.
Australian Examination Report dated Dec. 9, 2021, issued in AU2017394781.

* cited by examiner

BIOHAZARDOUS MATERIAL TRANSPORTING PIG

CROSS-REFERENCE TO RELATED APPLICATION

This application is a national stage application of PCT-application number PCT/CA2017/050689 filed on Jun. 6, 2017, which claims priority of Canadian patent application No. 2,955,469 filed on Jan. 20, 2017, both of which disclosures are incorporated herein by reference.

FIELD OF THE INVENTION

This invention relates to hazardous materials, for example radiopharmaceuticals. In particular this invention relates to a pig for storing, transporting and dispensing of liquid and capsules formulations of biohazardous products and substances in liquid and solid form, for example radiopharmaceuticals.

BACKGROUND OF THE INVENTION

The transportation of biohazardous materials and substances, for example radioactive materials or biological substances such as pathogens, presents a potentially dangerous situation and must be subject to strict controls.

For example, radioactive pharmaceutical products, commonly known as "radiopharmaceuticals," are prepared for patient injection, ingestion or other forms of administration in specially equipped and controlled facilities. Radiopharmaceuticals are well known for use as markers in nuclear medicine diagnostic procedures, and to treat certain diseases.

Unless properly shielded, such products become a radiation hazard for individuals handling the product. For example, radioiodine pills or capsules that can be used for treating certain pathologies such as thyroid diseases or in conjunction with a diagnostic procedure to diagnose certain types of illnesses, are stored before use in a container typically made of plastic, for example a polyethylene pill bottle. In the case of a liquid radiopharmaceutical the container is typically a glass vial. Neither of these containers have any radioactivity-shielding properties. Therefore the storage, transportation and dispensing of radiopharmaceuticals is carefully controlled by rules designed to regulate the handling of such materials in a manner that reduces the radiation hazard.

Each metered (for example assayed or calibrated) dose of the radiopharmaceutical product, for example in the case of a treatment for thyroid issues a radioiodine pill, or in the case of isotopes used in Nuclear Medicine (SPECT) and positron emission tomography (PET) diagnostic procedures a liquid, is placed by the manufacturer into the container to be shipped to a qualified facility for administration to a particular patient or patient category. At the radiopharmacy stock vials of different radiopharmaceuticals are dispensed as unit doses. This represents the first opportunity for hazardous exposure to the radioactive contents, and accordingly is effected at the manufacturer in a shielded booth or other enclosure, or under other radioactivity-shielded conditions.

The container containing the radiopharmaceutical must then be shipped to the destination hospital or clinic for administration to the patient. To effect this safely, the container is dropped into a radioactivity-shielding container commonly known as a "pig" for interim storage and delivery to the destination.

A conventional pig comprises a two-part vessel which is either formed from a radioactivity-shielding material, for example lead or tungsten, or has an exterior shell encasing a radiopharmaceutical container compartment that is lined with a radioactivity-shielding material such as lead or tungsten. A non-limiting example is described and illustrated in U.S. Pat. No. 6,586,758 issued Jul. 1, 2003 to Martin, which is incorporated herein by reference in its entirety.

When the pig is assembled, the radiopharmaceutical container compartment is sealed in order to contain the radiation and thus minimize human exposure to the radioactive contents of the radiopharmaceutical compartment. The compartment is sized to accommodate the radiopharmaceutical product, in the ingestible radioiodine example a pill or dissolving capsule, or in the case of a liquid of radiopharmaceutical a vial, syringe, ampule or other glass container. In each case the radiopharmaceutical compartment would be dimensioned accordingly.

Once the radiopharmaceutical container has been placed into the radiopharmaceutical compartment and the pig assembled, the pig is ready to be shipped to the patient's location. Because this part of the delivery process occurs entirely within the confines of the manufacturing plant, which is specifically designed and staffed so as to meet all regulatory guidelines and procedures, there is less chance of human exposure to the radioactive radiopharmaceutical product up to the point that the pill, capsule, vial, syringe or the like is sealed in the radiopharmaceutical container compartment of the pig. As is well known, the pig is designed to provide optimal shielding so as to reduce exposure during shipping. The transportation phase is a second opportunity for exposure to the radioactive contents of the radiopharmaceutical container, posing an occupational exposure opportunity for the driver/courier.

At the destination staff trained in handling radioactive substances, for example a nuclear medicine technologist or technician, opens the pig and then removes the closure from the radiopharmaceutical container to vent the container bottle. This is the third opportunity for exposure to the radioactive contents of the radiopharmaceutical container, in the presence of hospital or clinic staff. The technologist must transfer the radiopharmaceutical to a Dose Calibrator to assay (measure) the activity of the radiopharmaceutical, which must be within 10% of prescribed activity. After recording the assay, the technologist must retrieve container containing the radiopharmaceutical and return the radiopharmaceutical container to the pig's radiopharmaceutical container compartment, which is the third opportunity for exposure to radioactivity. The technologist then applies the lid to the pig for delivery to the patient.

The pig is opened in the patient's presence in order to gain access to the radiopharmaceutical container and remove the container closure for administration of the radiopharmaceutical product to the patient, providing a fourth opportunity for exposure to the radioactive contents of the radiopharmaceutical container. In this step exposure of radioactivity to the ambient environment is unavoidable in order to access the radiopharmaceutical product for administration to the patient, so great care must be taken to handle the unshielded radiopharmaceutical product using proper safety equipment and procedures.

However, the assaying process, and the venting of the container in the case of certain volatile radioactive substances which produce radioactive iodine vapours such as 131 Iodine capsules, can present unnecessary points of risk of exposure to the technologist and other staff. Although the types of destination facilities to which these products are shipped are equipped to properly handle radiopharmaceutical products and the staff at such facilities are well trained in safety policies and procedures, this step in particular can increase the risk of human exposure to the radioactive contents of the radiopharmaceutical product.

There is accordingly a need for a radiopharmaceutical pig that reduces opportunities for human exposure to the contents of the container when the pig reaches a hospital or clinic setting and the product in the container is exposed to the ambient environment.

SUMMARY OF THE INVENTION

In accordance with an aspect of the invention, there is provided a pig for transporting a container of biohazardous material, wherein the container comprises a bottle and a bottle closure, the pig comprising: a body comprising a compartment dimensioned to receive the container; a cap attachable to the body for closing the compartment thereby to shieldingly contain the biohazardous material in the container, the cap comprising: a collar sealingly engageable with the body and having an opening therethrough in communication with the compartment thereby to provide access to the bottle closure; a cap closure sealingly engageable within the opening of the collar to sealingly close the opening and cause the bottle closure to be gripped within the cap, wherein when the collar is disengaged from the body while the cap closure is engaged within the opening of the collar, the container remains gripped within the cap.

In an embodiment, the pig comprises a compression member dimensioned to be positioned intermediate the bottle closure and the annulus, the compression member being compressed against the bottle closure by the annulus while the cap closure is sealingly engaged within the opening of the collar.

According to another aspect of the invention, there is provided a system for transporting and providing access to a biohazardous material, the system comprising the pig; and an insert sealingly engageable within the opening of the collar while the cap closure is removed, the insert comprising an injection port extending fully therethrough in axial alignment with the compartment thereby to guide insertion of a syringe centrally through the container closure and into the container.

According to another aspect of the invention, there is provided a compression member for insertion into a pig for transporting a container of biohazardous materials, the compression member comprising: a flange; and spaced apart fingers supported by the flange and together forming a circle, the fingers each having a substantially vertical component extending upwards from the flange and a substantially horizontal component extending inwards from an end of the substantially vertical component distal from the flange, the spaced apart fingers resiliently compressible inwardly against the container by compressive engagement of a complementary annulus of the pig into which the compression member is dimensioned to be inserted.

BRIEF DESCRIPTION OF THE DRAWINGS

In drawings that illustrate an embodiment of the invention by way of non-limiting example only.

DETAILED DESCRIPTION OF THE INVENTION

Figure 1:
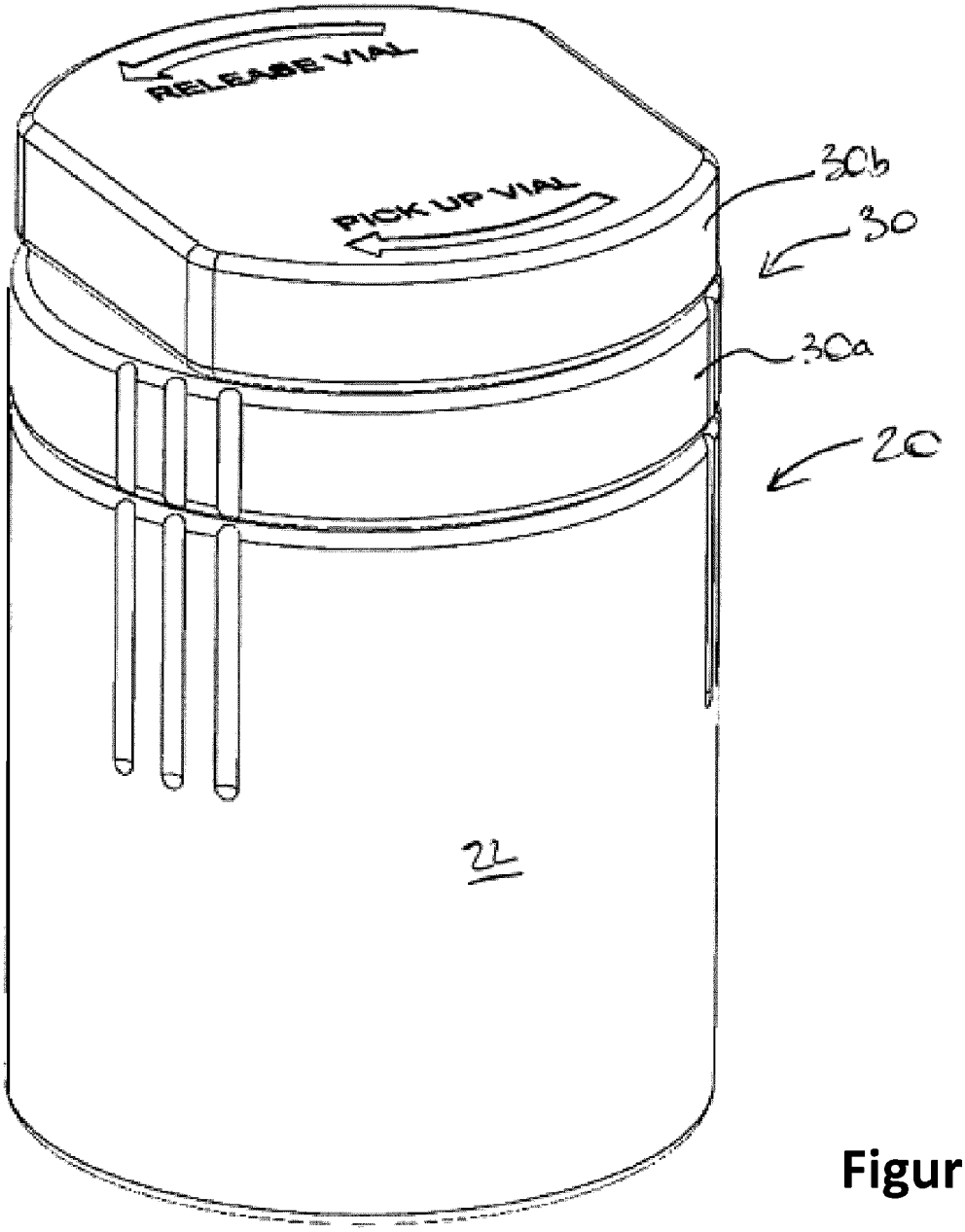
FIG. 1 is a perspective view of a radiopharmaceutical pig according to the invention.

The invention relates to a pig 20 for transporting a container 10 containing a biohazardous product. The advantages of the invention are particularly applicable in the case of radiopharmaceuticals, whether in solid or liquid form. However, the pig 20 may be configured to be suitable for transporting virtually any type of radiopharmaceutical product, and is also suitable for transporting other types of biohazardous products or substances such as biological pathogens. One or more advantages can be obtained in the use of a pig according to the invention for storing and transporting any kind of biohazardous product where access to the internal (non-protective) container holding the biohazardous product is required intermittently. The embodiments of the invention described herein are for purposes of example only and the invention is not intended to be limited to the specific embodiments described.

A biohazardous materials container, for example a radiopharmaceutical container 10 as shown, comprises a bottle 12 and a closure 14 for sealing the bottle 12. The container 10 may be made of any suitable material, typically plastic or glass depending upon the type and form of radiopharmaceutical contained therein. For example in the embodiment shown in FIG. 2 the container 12 is a glass vial containing a liquid radiopharmaceutical 2.

The cap 30 of the pig 20 is configured 1) to allow the container 10 to be removed from the body 22 of the pig 20 while secured to (and thus in part shielded by) the cap 30, and 2) to allow the closure 14 to be removed from the bottle 12 without opening the pig 20 in order to avoid exposing the user to the radioactive contents of the product, as described in detail below. In the embodiment shown the bottle 12 comprises a bead 12*a* about its neck, and the closure 14 is a stopper-type closure having a body 14*a* which closes the neck of the bottle 12 in an interference fit. In other containers 10 the closure may be clinched to the neck of the bottle 12. In the case of liquids the closure 14 is typically provided with a generally central septum 14*b* (see FIG. 12) for penetration by a syringe in order to extract the contents of the bottle 12.

The pig 20 in the embodiment illustrated a radiopharmaceutical pig 20, comprises a cylindrical body 22 and a complementary cylindrical cap 30 for attachment to the body 22.

The components of the radiopharmaceutical pig 20 shown may be formed from a radioactivity-shielding material such as lead or tungsten, or may be formed from any suitably strong metal or plastic. In the case of the radiopharmaceutical pig 20 shown the portions surrounding the compartment 24 are lined with a suitably radioactivity-resistant liner formed from a material such as lead or tungsten. If the pig is used to transport toxins, biological pathogens or other non-radioactive products or substances, the compartment 24 may be hermetically sealed when the pig 20 is closed to prevent exposure to the ambient environment.

Figure 4:
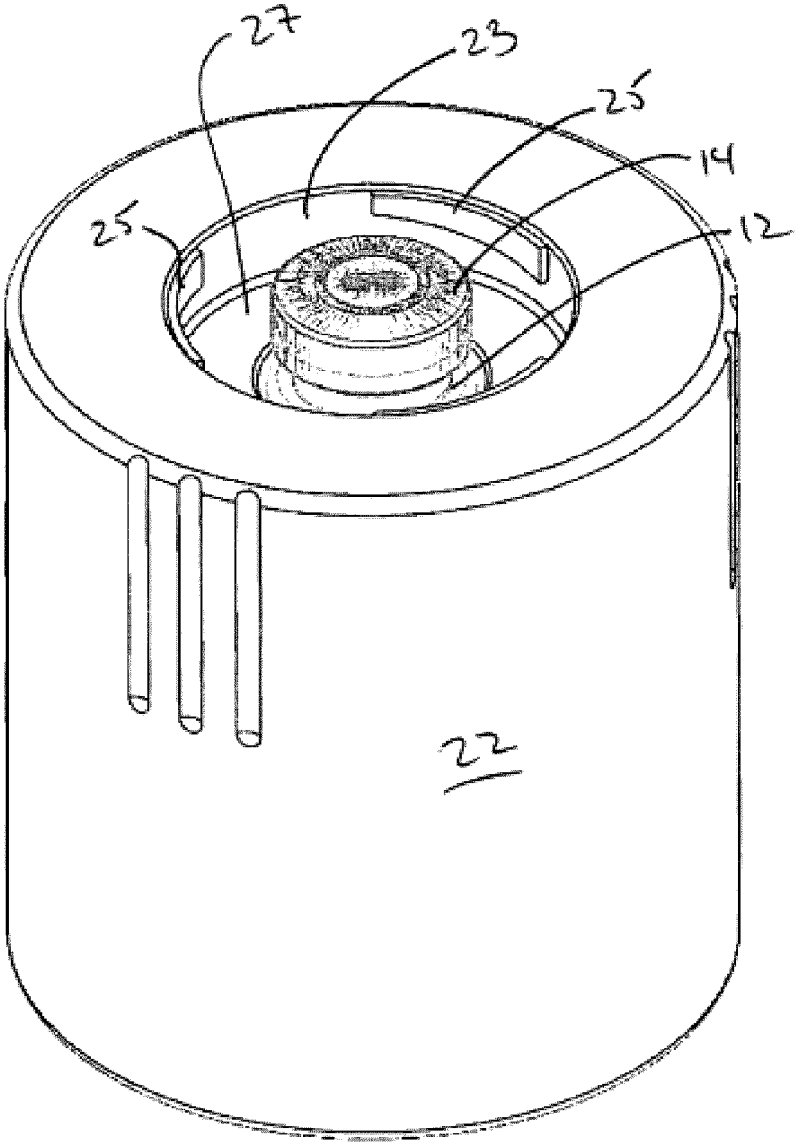
FIG. 4 is a perspective view of the radiopharmaceutical pig of FIG. 1 with the cap removed and the radiopharmaceutical container in the body of the pig.

The body 22 comprises a recess concentric with and overlying the radiopharmaceutical container compartment 24, forming a throat 23 which provides projecting cams 25 along its interior wall, as best seen in FIG. 4. The cap 30 comprises a two-stage closure for sealing the biohazardous container compartment 24 against radioactivity leakage.

Figure 5:
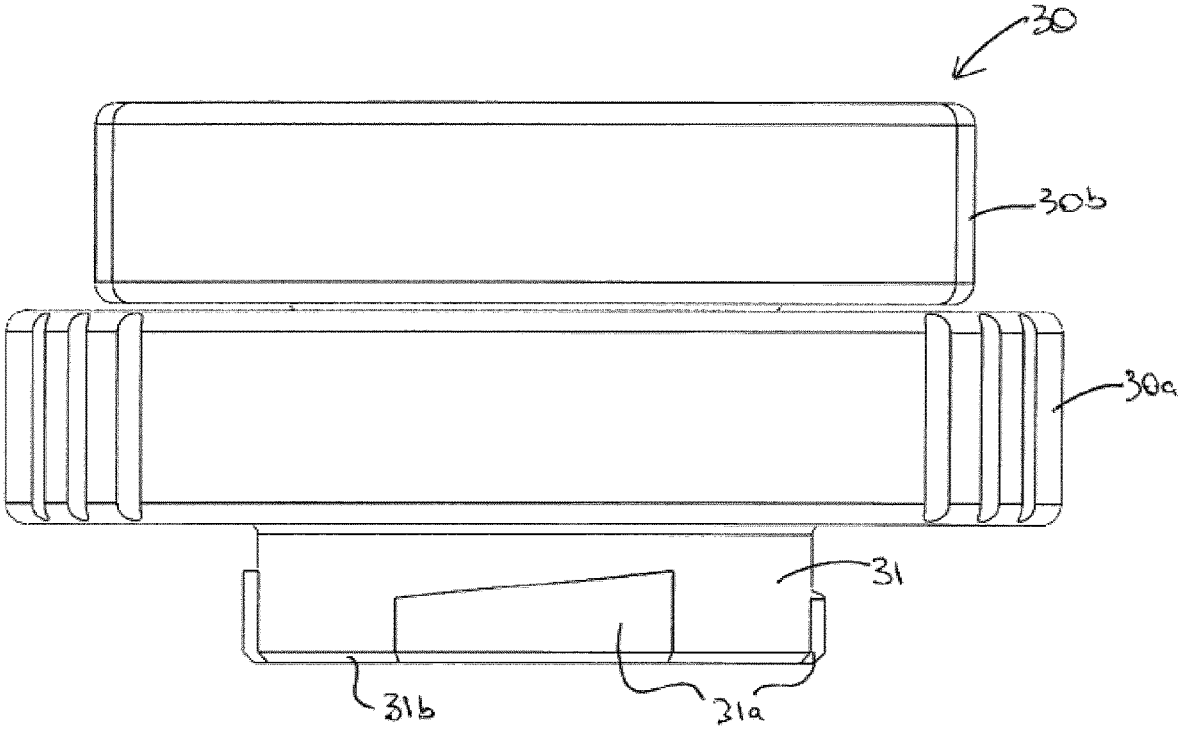
FIG. 5 is an elevation of the cap.

The first body closure stage comprises an outer collar 30*a* that fits within the throat 23 of the body, which when secured to the body 22 extends into and sealingly engages with the throat 23. In the embodiment illustrated the collar 30*a* comprises a projecting collar neck portion 31 that provides external projecting cams 31*a*, best seen in FIG. 5, which are complementary to the cams 25 about the throat 23 and positioned so that when the neck 31 of the collar 30*a* is secured into the throat 23 above the biohazardous materials container compartment 24 by partial (e.g. 60 degree) rotation in a 'bayonet' connection, the lower edge 31*b* of the neck 31 sealingly engages against the floor 27 of the throat 23 around its periphery and prevents radioactivity from escaping around the collar 30*a*.

Figure 7:
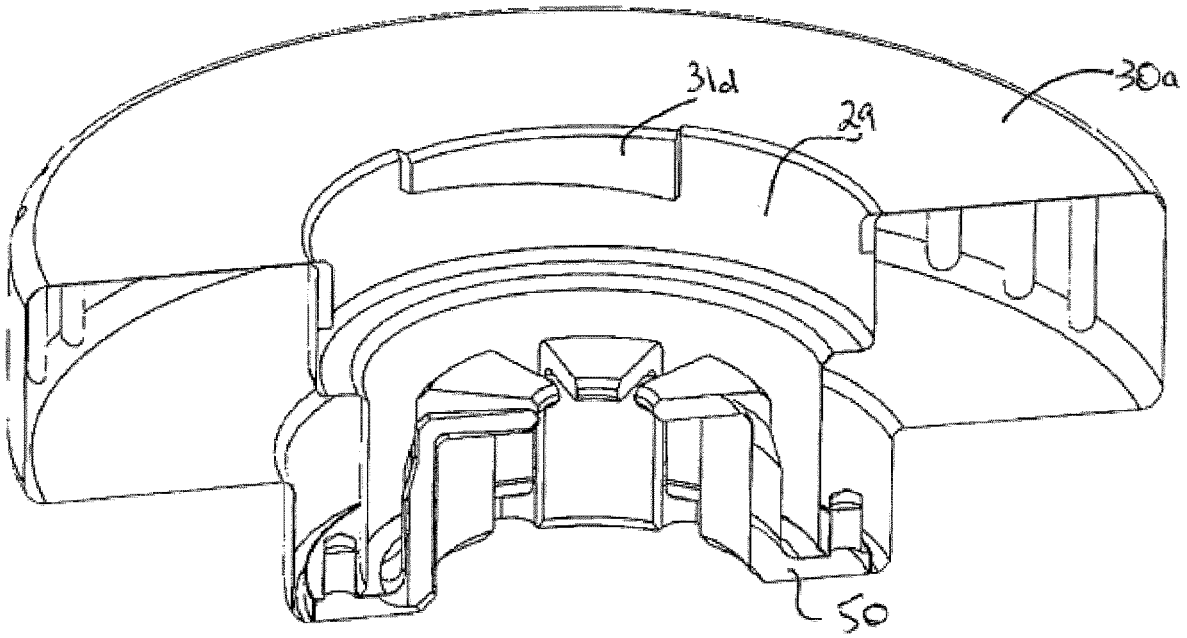
FIG. 7 is a cutaway perspective view of the cap taken from above.
Figure 8:
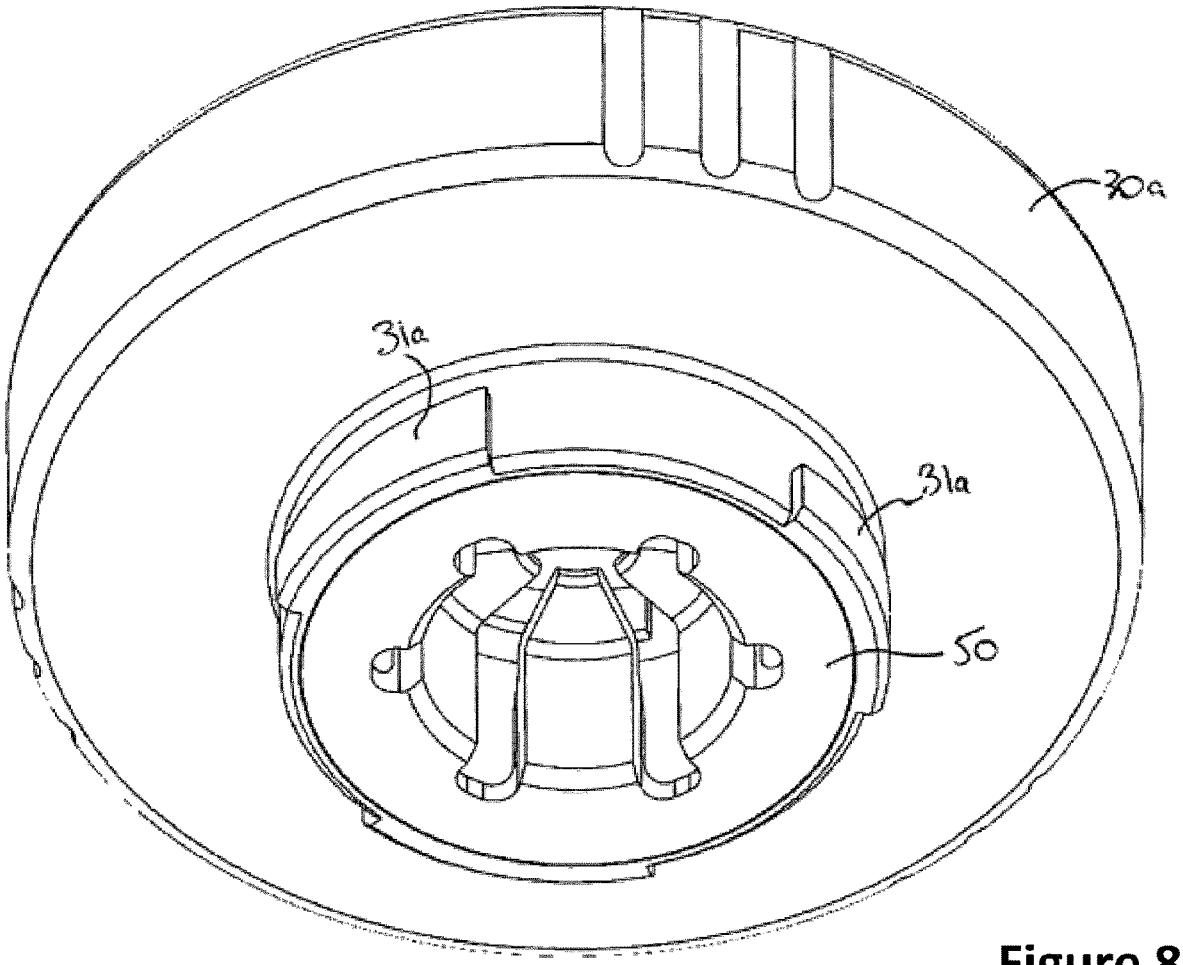
FIG. 8 is a perspective view of the cap taken from below.
Figure 9:
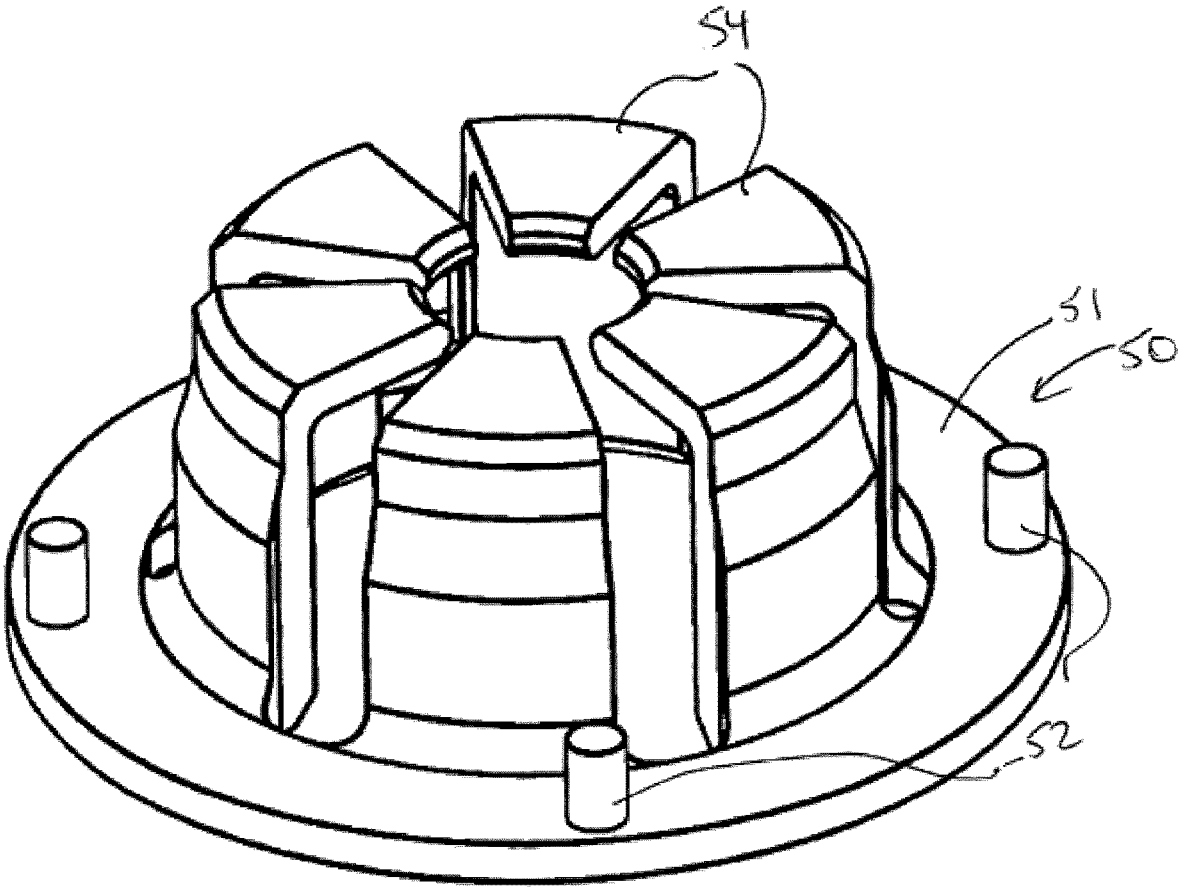
FIG. 9 is a perspective view of a compression member for assisting in securing the container closure to the cap.
Figure 10:
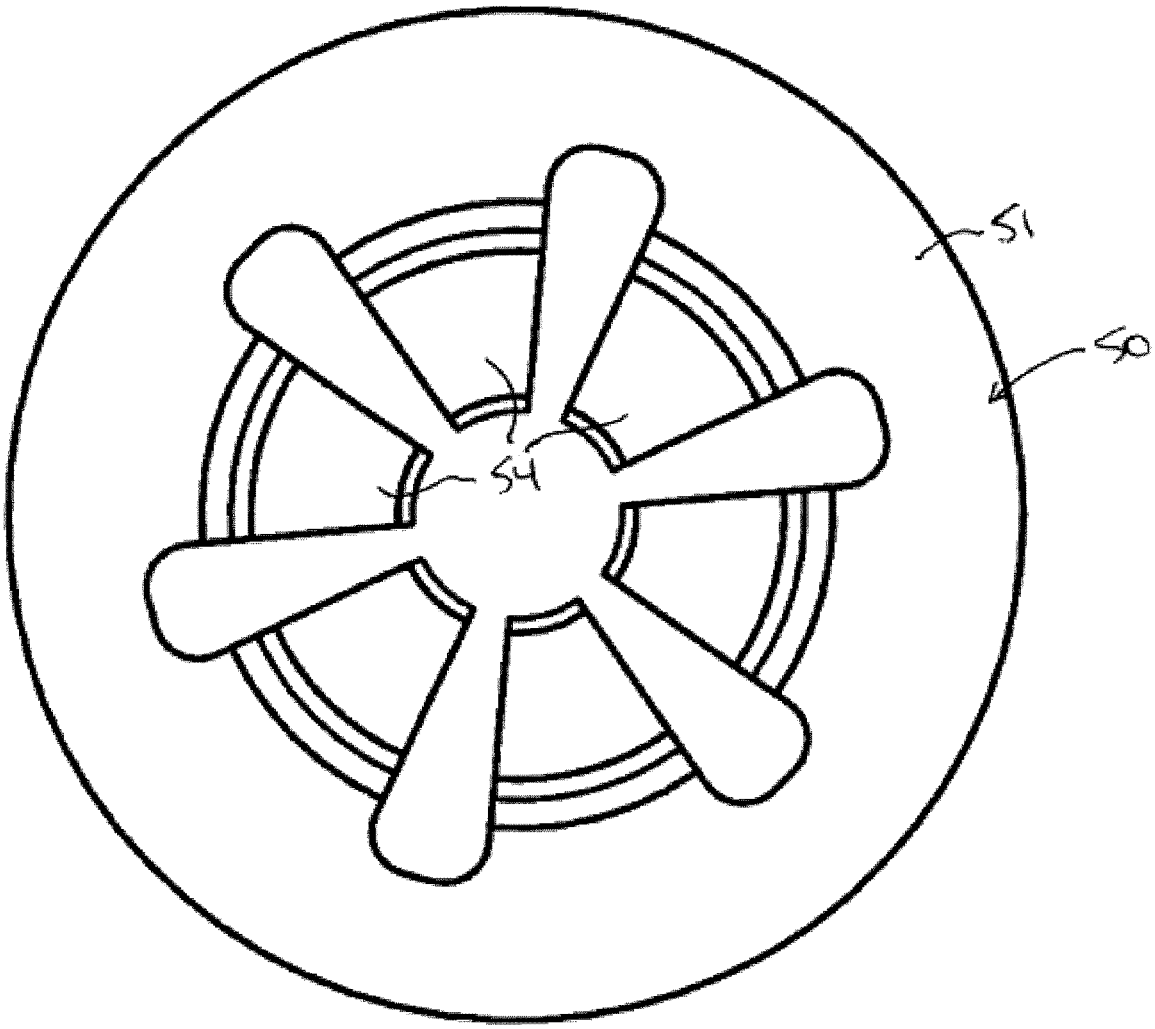
FIG. 10 is a plan view of the compression member taken from the bottom of FIG. 9.
Figure 11:
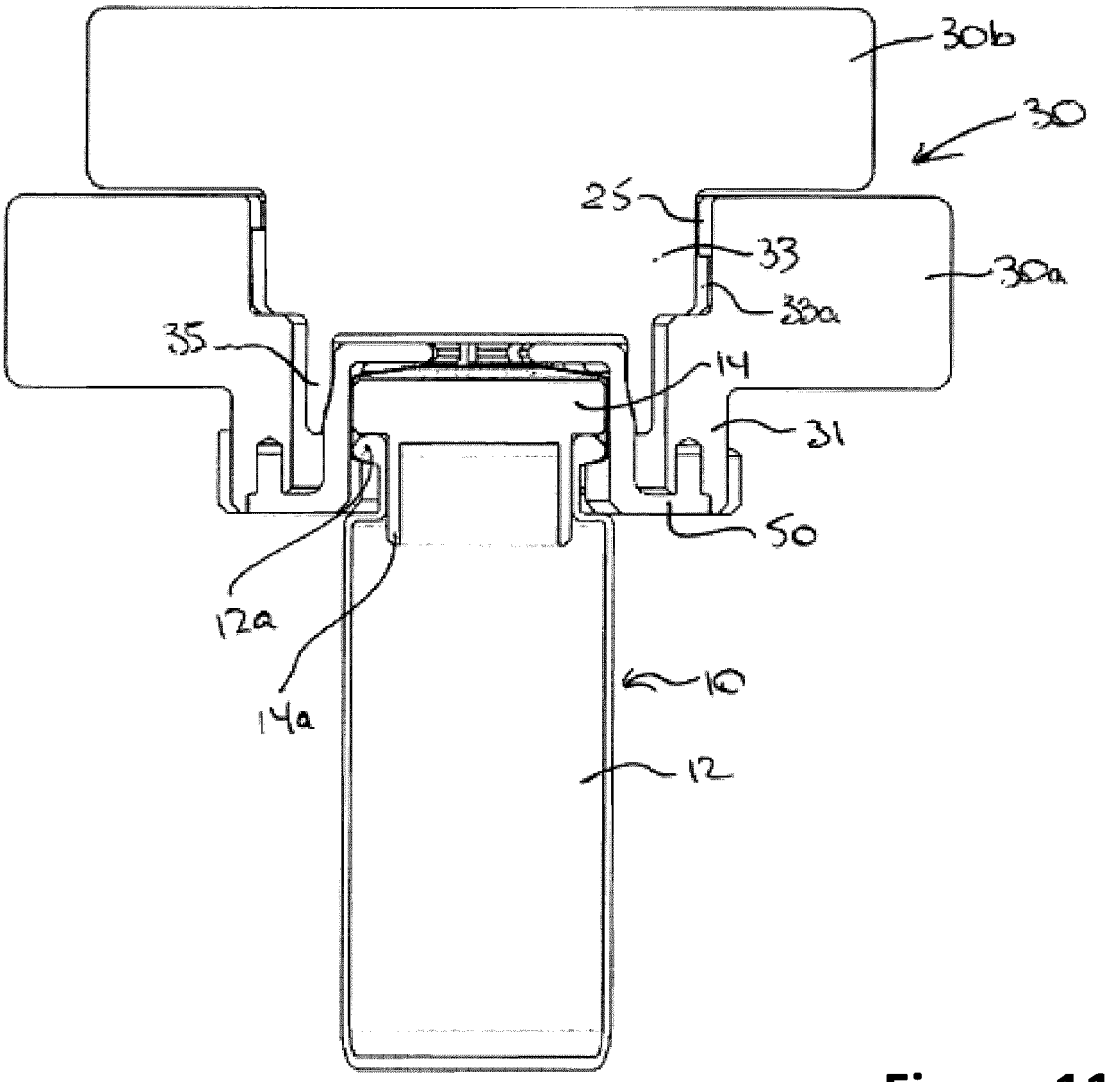
FIG. 11 is a cross-sectional elevation of the container secured in the cap.

The collar 30*a* comprises an orifice 29 extending through the body and neck 31 of the collar 30*a*, in communication with the biohazardous materials container compartment 24. The upper portion of the orifice 29 provides a larger diameter and projecting cams 31*d* (see FIG. 7) disposed about its interior surface, for receiving the cap closure 30*b* as described below. The orifice 29 narrows as it approaches the neck 31, creating a ledge 31*c* at an intermediate point for sealing engagement by the cap closure 30*b*. In some embodiments the narrower lower portion of the orifice 29 is adapted to receive a compression, or "grip", member 50 that functions to grip closure 14 as will be described below.

The cap closure 30*b* provides a cap closure neck 33 that fits into the orifice 29. In the embodiment illustrated the cap closure 30*b* comprises a projecting closure neck portion 33 that provides external projecting cams 33*a*, best seen in FIG. 6, that are complementary to the cams 31*d* and positioned so that when the closure neck 33 is secured into the orifice 29 by partial (e.g. 60 degree) rotation in a 'bayonet' connection, the lower surface 33*b* of the neck 33 sealingly engages against the ledge 31*c* of the orifice 29 around its periphery and prevents radioactivity from escaping through the orifice 29.

The cap closure 30*b* attaches to the collar 30*a* in a compressive motion, such that the container closure 14 is gripped by the annulus 35 of the closure 30*b*. Although a bayonet fitting arrangement is a particularly convenient means of compressively attaching the cap closure 30*b* to the collar 30*a*, these components may be attached together in any other suitable manner that provides a compressive motion of the cap closure 30*b* relative to the collar 30*a*, for example by threading. Also, in the embodiment shown the body 22 and cap 30 have a cylindrical exterior, which simplifies the provision of a bayonet connection, however any other convenient configuration may be used with a closure mechanism suitable for substantially preventing leakage of radioactivity from the pig 20.

Figure 6:
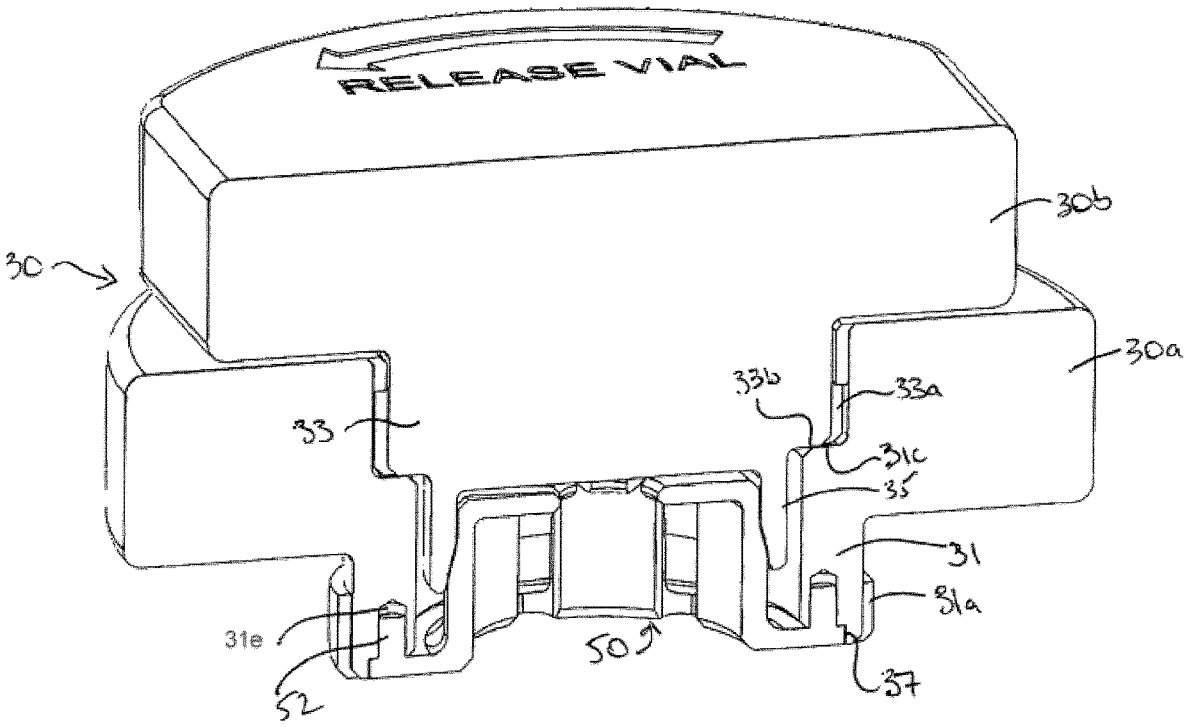
FIG. 6 is a cross-sectional perspective view of the cap taken from above.
Figure 12:
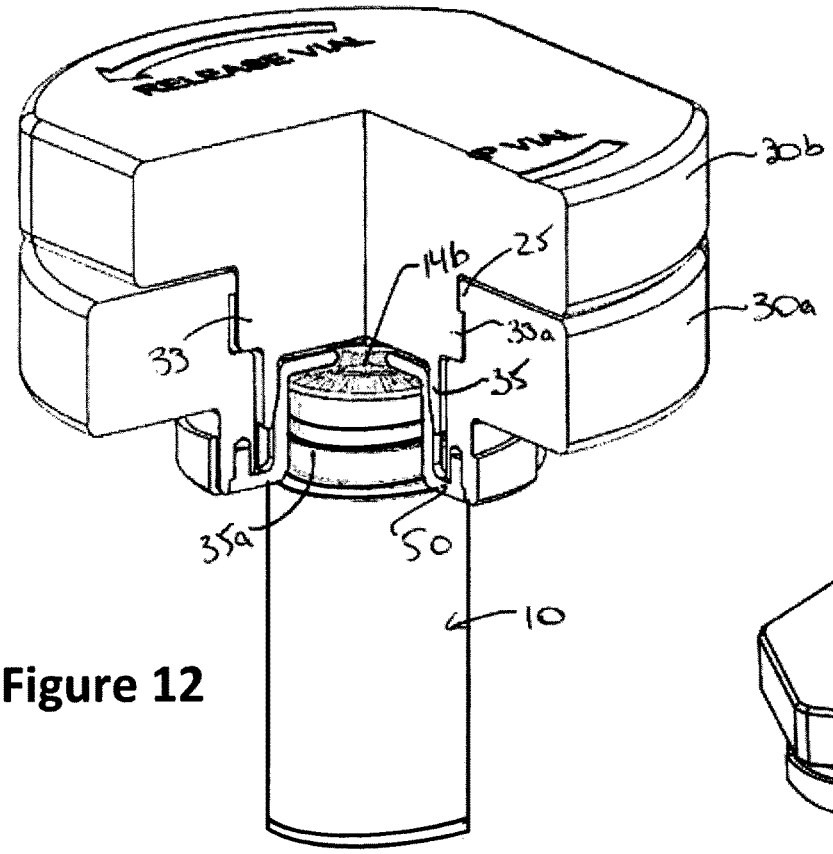
FIG. 12 is a cutaway perspective view of the container secured in the cap.

To improve the gripping action of the cap closure 30*b* compressed against the collar 30*a*, the somewhat resilient grip 50 may be disposed in the orifice. In the embodiment shown the grip 50 comprises a flange 51 supporting spaced apart fingers 54 that form a circle complementary to the inner wall of the annulus 35, as best seen in FIG. 6. The fingers 54 each have a substantially vertical component extending upwards from the flange 51 and a substantially horizontal component extending inwards from the end of the substantially vertical component thereby to overlap the container closure 14 to a degree as illustrated. In this embodiment the annulus 35 projects from the lower edge 33*b* of the closure neck 33 into the narrower portion of the orifice 29 in a clearance fit, as shown in FIG. 6, and instead of engaging the container closure 14 directly the annulus 35 defines a recess 35*a* adapted to engage the grip 50, best seen in FIGS. 6 to 10. In particular, when the cap closure 30*b* is attached to the collar 30*a* the annulus 35 compressively engages the fingers 54 of grip 50 to collapse the fingers 54 toward each other against their tendency to remain substantially vertical (that is, to tilt fingers 54 inwardly against their bias) and grip the container closure 14, as shown in FIG. 12. When the cap closure 30*b* is disengaged from the collar 30*a* the annulus 35 does not compress the fingers 54 inwards against the container closure 14 thus permitting fingers 54 to spread apart again as per the resiliency to remain substantially vertical (that is to enable fingers 54 to tilt outwardly again to the substantially vertical orientation to which they are biased) enabling the top of container closure 14 to be more exposed through the orifice.

The grip 50 may be formed from a semi-compressible material such as plastic (such as a thermoplastic such as Delrin™ available from Dupont Corporation of Wilmington, Del., U.S.A. or polypropylene) or silicone, and has an external profile allowing it to fit snugly within the recess 35*a* of the annulus 35, and an internal profile allowing the closure 14 of the biohazardous container 10 to fit snugly within the grip 50, as shown in FIG. 12. The grip 50 may be provided with a pattern of openings, increasing the overall compressibility of the grip 50 and reducing its cost.

The lower end of the annulus 35 has a slightly diverging wall which is drawn downwardly against the grip 50 as the collar 30*a* is engaged to the body 22, compressing the grip 50 slightly. The grip 50 thus provides a buffer between the incompressible interior surface of the annulus 35 and the container closure 14, which in the example shown is a stopper engaged with the neck of the container 12 in an interference fit thereby capping the container 12. This both allows the closure 14 to be held securely by the cap 30 and, where the biohazardous container 10 is made of glass, potentially avoids breakage. As in the embodiment illustrated the grip 50 may be frictionally and secured to the collar by lugs 52 projecting into complementary bores 31*e* formed in the lower edge of the neck 31 of the collar 30*a* thereby to inhibit rotation and translational exit from the bores 31*e*. In other embodiments (not shown) the periphery of the flange 51 may snap-fit onto the recess 37 formed in the bottom surface of the collar 30*a* (see FIG. 6), for example by proving a slight reverse-chamfer in the recess wall so it converges toward the lower limit of the collar 30*a*, retaining the flange 51, which avoids having to line up the lugs 52 with bores 31*e*.

The grip 50 can be supplied in a single-use sterile package for the plastic piece, or can be pre-loaded to vial and both sterilized together. Different sizes of vial would dictate a corresponding change in the diameter of the compartment 24, but such vials tend to have a standard neck and same septum circumference and in such cases the same size of cap 30 and grip 50 can be used.

In the case of the radiopharmaceutical pig 20 shown, the assembled cap 30 and body 22 thus provide a radioactively-shielded compartment 24, for shielding the radioactive contents of the radiopharmaceutical container 10 contained when sealed into the radiopharmaceutical compartment 24. In the embodiment shown the compartment 24 is defined by a cavity formed largely within the body 22 which is sized to receive the bottle 12 in a close fit, preferably a clearance fit but alternatively an interference fit, however the compartment 24 may be formed by defined by suitably sized and aligned adjoining cavities formed respectively in the body 22 and the cap 30.

Thus, when the closure remover 34 is seated over the compartment 24 it closes the cap opening 32 in order to radioactively seal the radiopharmaceutical compartment 24. Also, when the cap 30 is removed from the body 22 it is possible to manipulate the sealed container 10 by handling only the cap 30, thereby shielding the technologist's extremities from radiation.

To preserve a radiopharmaceutical pill (not shown), the bottle 12 optionally may be provided with fins (not shown) that confine the pill 2 to an axially central portion of the container 10 and thus reduce the amount of pill surface touching the bottle 12.

Figure 2:
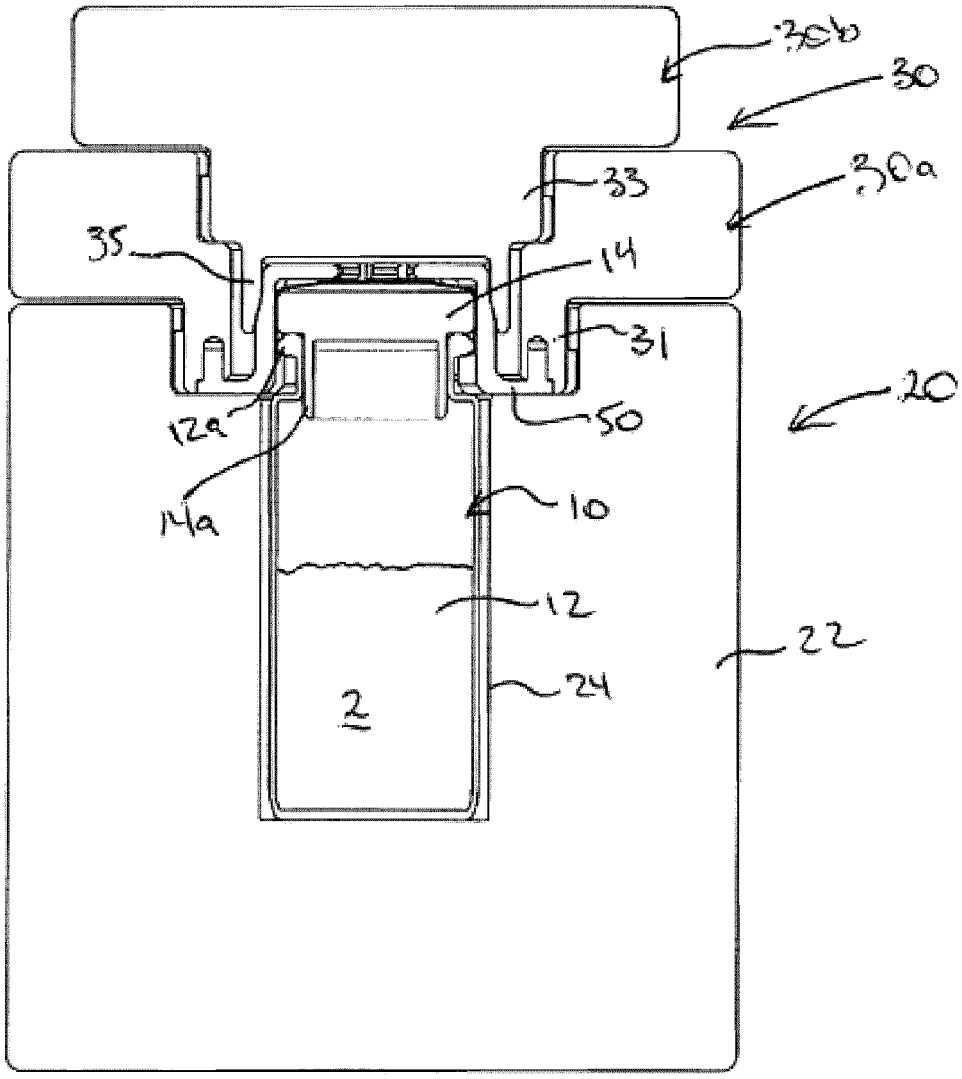
FIG. 2 is a cross-sectional elevation of the radiopharmaceutical pig of FIG. 1.

In use of the embodiment shown, a radiopharmaceutical liquid or solid material (e.g. a pill) is placed into the bottle 12 using conventional techniques and equipment to avoid exposure to staff. A radioisotope solution 2 in a glass bottle 12 is illustrated in FIG. 2. In the case of a liquid radiopharmaceutical product the vial typically arrives already filled with the radioactive liquid. The closure 14 may optionally be designed to accommodate a desiccant or other product-stability material or method (not shown) in order to control the humidity within the container 10.

The closure 14 is applied to the container 10 which is then placed into the container compartment 24. The cap 30 is placed on the body 22 of the pig 20 and rotated in the closing direction to engage the cams 25, 31*a* and to seal the cap 30 tightly to the body 22, confining radioactivity from the pill 2 within the container compartment 24.

The pig 20 can then be transported to the patient's facility for administration of the biohazardous material, in the example shown a liquid radioisotope.

When the pig 20 arrives at the destination, the pig 20 is taken to a room designed to contain the radioactivity and protect staff, as is conventional. The technician grasps the collar 30*a* and ensures that the cap closure 30*b* is fully rotated in the direction that locks it to the collar 30*a*, clockwise in the embodiment illustrated as indicated by the 'pick up vial' arrow in FIG. 1. This lodges the container closure 14 into the annulus 35, where a grip 50 is used squeezing the grip 50 against the container closure 14, to lock the container 10 to the cap 30.

Figure 3:
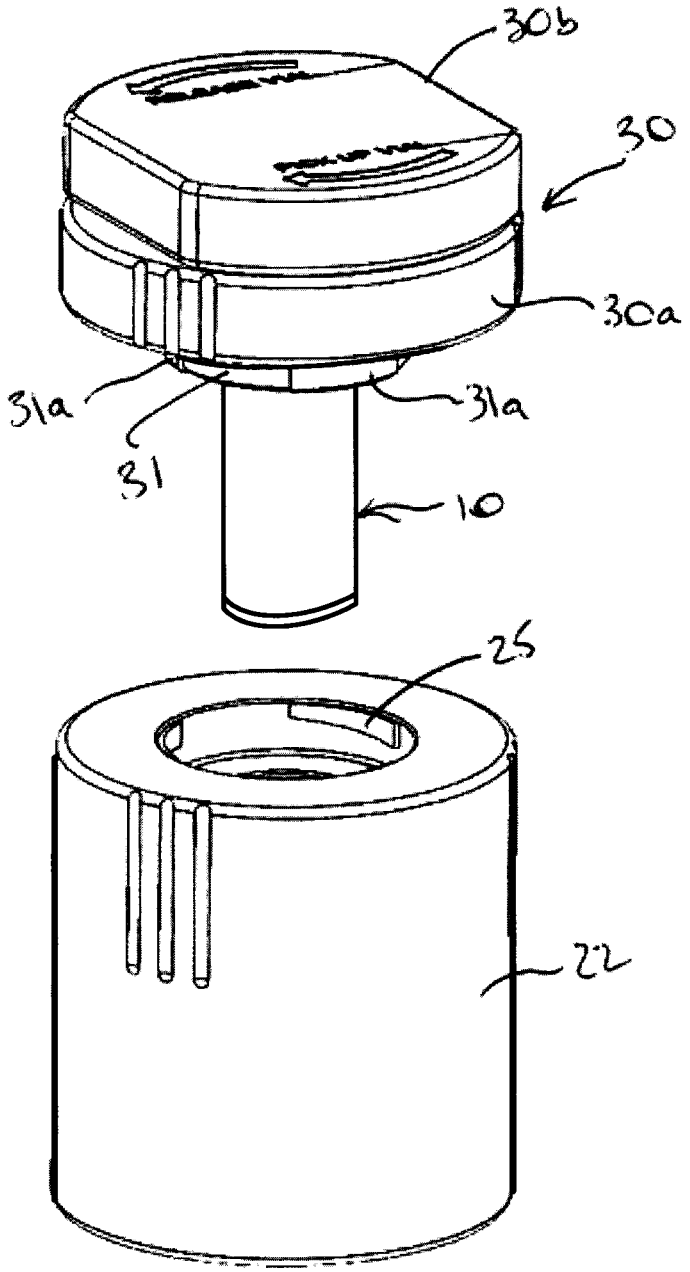
FIG. 3 is a perspective view of the radiopharmaceutical pig of FIG. 1 with the cap removed and a radiopharmaceutical container secured to the cap.
Figure 13A:
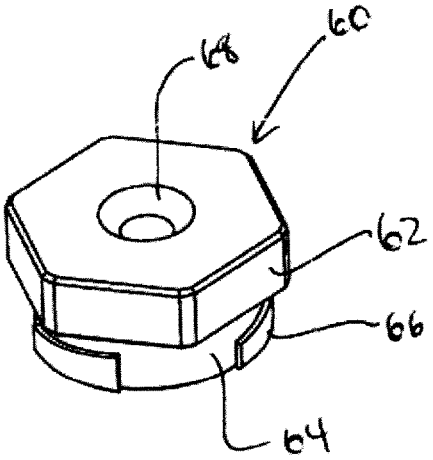
FIG. 13A is a perspective view of an injection port for use with biohazardous liquids.

The technician then grasps the body 22 and rotates the cap 30 collar (30*a* and cap closure 30*b* together) to remove the cap 30 from the body 22 with the container closure 14 lodged in the annulus 35 (or where a grip 50 is used, in the grip 50), and lifts the cap 30 off the body 22 as shown in FIG. 3.

Where the biohazardous material is a liquid and the cap 14 of the bottle (typically a vial) 12 provides a septum 14*b* or other entry orifice for a syringe (not shown), the closure 30*b* can be removed from the collar 30*a* to expose the top of the container closure 14 and allow the insertion of a syringe without releasing the vial from the collar 30*a*. A tungsten insert 60, for example as shown in FIG. 13A, may be provided to replace the cap closure 30*b*. The insert 60 comprises a head 62 and a neck 64 that fits into the orifice 29 in the collar 30*a*. In the embodiment illustrated the neck 64 of the insert 60 provides external projecting cams 66 that are complementary to the cams 31*d* and positioned so that when the insert 60 is secured into the orifice 29 by partial (e.g. 60 degree) rotation in a 'bayonet' connection, the lower surface of the neck 64 sealingly engages against the ledge 31*c* of the orifice 29 around its periphery. The syringe may be inserted into the septum through an injection port 68 extending fully through the insert 60 in axial alignment with the compartment 24 of the body 22. In this embodiment, the injection port 68 is cylindrical and has a single diameter throughout its length. The insert 60 provides enhanced radiation protection while dispensing from multi dose vial (stock) due to its smaller-diameter injection port 68 through a head 62 and neck 64 of tungsten, as well as guidance for a syringe to be inserted centrally into the container 10 through the container closure 14. In alternative embodiments, the injection port may be frustoconical.

Figure 13B:
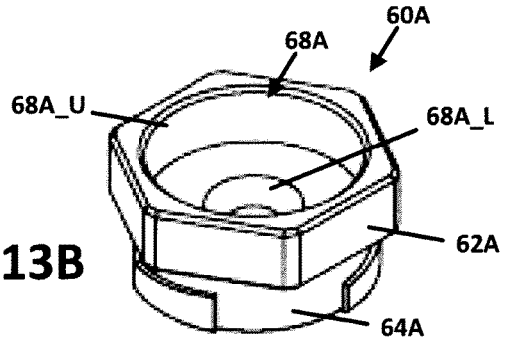
FIG. 13B is a perspective view of an alternative injection port for use with biohazardous materials.

An alternative tungsten insert 60A is shown in FIG. 13B. In this embodiment, tungsten insert 60A has an injection port 68A that has an upper portion 68A_U extending partway through the insert 60A (substantially the height of head 62A) with a larger maximum diameter than does injection port 68 of insert 60, and a lower portion 68A_L extending from the upper portion 68A_U through the rest of the insert 60A (substantially the height of neck 64A) with a smaller diameter (in this embodiment, similar to the diameter of injection port 68 of insert 60). This larger diameter of the upper portion 68A_U permits the ease of insertion and angling of multiple outlet or inlet conduits (such as other syringes or needles thereof) while also permitting a user sufficient room to insert a syringe for withdrawing contents of the container 10. It will be noted that the thickness of a tungsten neck 64A is suitable for sufficient radiation protection in many instances such that there need not be significant concern about the head 62A accommodating the larger upper portion 68A_U of the injection port 68A rather than providing the additional shielding. In this embodiment, each of upper portion 68A_U and lower portion 68A_L are cylindrical. However, in an alternative embodiment, one or both of upper portion 68A_U and lower portion 68A_L of injection port 68A may be frustoconical in shape. Still further, in another alternative embodiment, the upper and lower portions 68A_U and 68A_L of injection port 68A may be replaced by a single, frustoconical injection port with the widest end having a diameter similar to that shown in FIG. 18B at the upper end of the insert 60A.

The container 10 can be released by grasping the collar 30*a* and fully rotating the cap closure 30*b* in the direction that unlocks it from the collar 30*a*, counter-clockwise in the embodiment illustrated as indicated by the 'release vial' arrow in FIG. 1.

In use, the biohazardous material is placed in the container 10 by the manufacturer, placed in the container compartment 24 of the pig 20, and shipped to the destination. A technician at the destination removes the cap 30 with the container 10 attached, moves the container 10 to a dose calibrator (not shown) and, while grasping the collar 30*a*, rotates the cap closure 30*b* to release the container closure 14 and (typically using tongs) insert the container 10 into the dose calibrator to measure (assay) amount of radioactivity. The bottle 12 is vented in the dose calibrator, if required (typically only in the case of radioiodine capsules).

The container 10 can then be re-sealed and the closure 14 reinserted into the grip 50. The technician while grasping the collar 30*a* rotates the cap closure 30*b* in the locking direction to secure the container closure 14 to the grip 50. The cap 30 is then replaced in the manner described above, and delivered to the patient for administration by a qualified professional.

At the patient site, in the case of a liquid the technician removes the cap closure 30*b* from the collar 30*a* and secures the insert 60 or insert 60A to the collar 30*a* by interlocking cams 66 and 25 in a bayonet fashion. The technician then inserts a syringe through the orifice 80 and the septum 14*b* to aspirate the liquid 2 from the bottle 12. The insert 60 or 60A can then be removed and the cap closure 30*b* replaced on the collar 30*a* to shield the residual radioactivity in the bottle 12.

The pig according to the invention can be used for any type of radioisotope, including those used for so-called "theranostics." Although tungsten shields gamma rays effectively, optionally a Lucite (Trademark) or Aluminum tube can be used to line the compartment 24 for materials having high beta emissions, for example to shield beta emissions from a radioisotope such as I-131. Bremsstrahlung occurs as beta particles strike a dense material like tungsten or steel, and the Lucite tube thus serves as a 'pillow' to reduce or eliminate bremsstrahlung x-rays.

Figure 14:
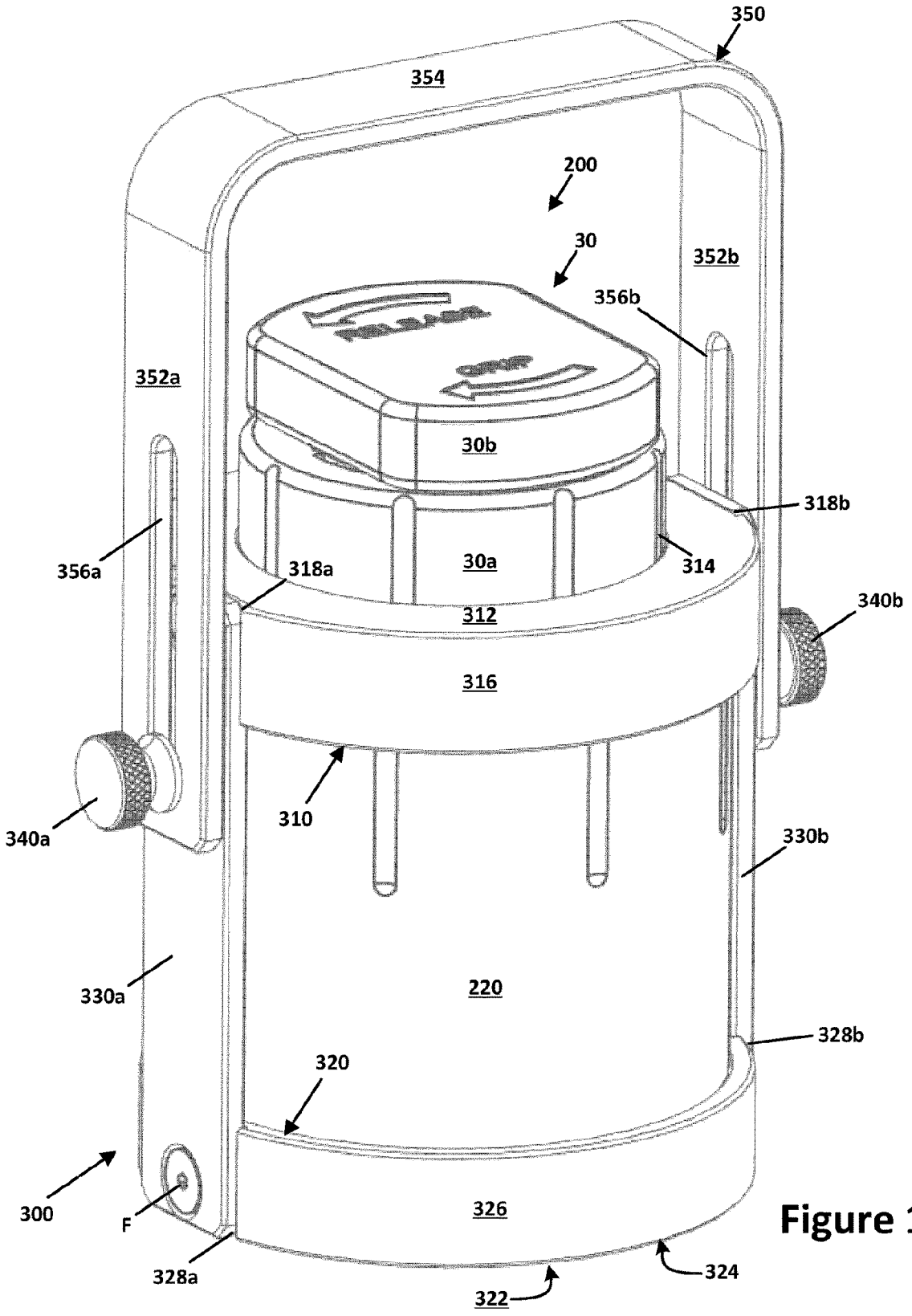
FIG. 14 is a front perspective view of a pig according to an alternative embodiment and a handle assembly for the pig.

FIG. 14 is a front perspective view of a pig 200 according to an alternative embodiment and a handle assembly 300 for the pig 200. In this embodiment, pig 200 is very similar to pig 20 described above, but the outer dimensions (in this embodiment, diameter) of the body 220 of pig 200 is larger than the outer dimensions of the collar 30*a* of the cap 30 of pig 200 and thereby presents a ledge extending laterally outwards from below collar 30*a* to the periphery of body 220.

As will be described, handle assembly 300 is configurable for carrying pig 200, for supporting pig 200 during extraction of contents of bottle contained within, and for inhibiting unintended removal of cap 30 particularly during transportation of pig 200.

In this embodiment, handle assembly 300 includes an upper collar 310 and a lower collar 320 maintained in a fixed spaced relationship by two struts 330*a*, 330*b* located opposite each other with respect to pig 200 and extending between the upper collar 310 and the lower collar 320.

Upper collar 310 includes a ring 312 with a central opening 314 and an outer diameter that is slightly larger than the outer diameter of body 220 of pig 200, and a wall 316 depends downwards at right angles to the ring 312 about its periphery. The diameter of the central opening 314 is slightly larger than the diameter of collar 30*a* so that the upper collar 310 can be associated with the body 220 of pig 200 by being placed atop the body 220 such that the ring 312 of upper collar 310 directly faces the ledge of body 220 with the wall 316 of the upper collar 310 extending down a short distance along the exterior of body 220.

In this embodiment, lower collar 320 is identical to upper collar 310, but is oriented upward thereby to be associated with the bottom of body 220 by receiving the bottom of body 220 within its peripheral wall 326. It will be understood that, while upper and lower collars 310, 320 are identical in this embodiment, the lower collar 320 in this embodiment does not really need its own central opening 322 to fulfil its function since the bottom of body 220 does not have a corresponding feature.

In this embodiment, upper collar 310 and lower collar 320 are made of Delrin™—a high-load thermoplastic available from Dupont™ Corporation of Wilmington, Del., U.S.A. or distributors thereof.

Each of struts 330*a*, 33*b* is connected at a proximate end to the wall 316 of upper collar 310 and at a distal end to the wall 326 of lower collar 320. In this embodiment, channels 318*a*, 318*b*, 328*a* and 328*b* in the outer face of the peripheral walls 316, 326 of each of upper and lower collars 310, 320 receives corresponding proximate and distal ends of a strut 330*a* or 330*b*, and the proximate and distal ends of the strut 330*a* or 330*b* are locked within the corresponding channels 318*a*, 318*b*, 328*a*, 328*b* with fasteners F. In this way, the upper and lower collars 310, 320 contain body 220 of pig 200 such that it is not separable from the upper and lower collars 310, 320 unless these fasteners F are removed.

Each of struts 330*a*, 330*b* has an outward-facing threaded aperture along its outward-facing surface and intermediate its proximate and distal ends for receiving the threaded end of a corresponding knob 340*a* or 340*b* via a corresponding washer 341*a*, 341*b*. A U-shaped handle 350 has elongate arms 352*a* and 352*b* each depending from a cross member 354, and each of the elongate arms 352*a*, 352*b* has therethrough an elongate channel 356*a*, 356*b*. The handle 350 is connectable to the struts 330*a*, 330*b* by passing knob 340*a*, 340*b* through a respective elongate channel 356*a*, 356*b* threading the knobs 340*a*, 340*b* into its corresponding threaded aperture in the strut 330*a*, 330*b*. In this configuration, if both of the knobs 340*a*, 340*b* are not fully threaded into corresponding threaded apertures, they do not compress respective arms 352*a*, 352*b* against the corresponding strut 330*a*, 330*b*, such that the channel 356*a*, 356*b* and correspondingly the handle 350 can be both freely rotated about and freely slid along the corresponding knob 340*a*, 340*b* while remaining generally connected to the rest of the handle assembly 300. In this way, the handle 350 can be moved between various rotational and extensional orientations with respect to the body 220 of pig 200. If any or both of the knobs 340*a*, 340*b* are tightened so as to press the arms 352, 352*b* against the struts 330*a*, 330*b*, the handle is held frictionally in position and is thereby prevented from rotating or sliding with respect to the struts 330*a*, 330*b*. It is preferred that the operator tighten both knobs 340*a*, 340*b* when intending to maintain the handle 350 in a particular fixed position with respect to the body 220, since the body 220 and the closure 30, being formed with dense, thick walls of tungsten, can be quite heavy.

Figure 15:
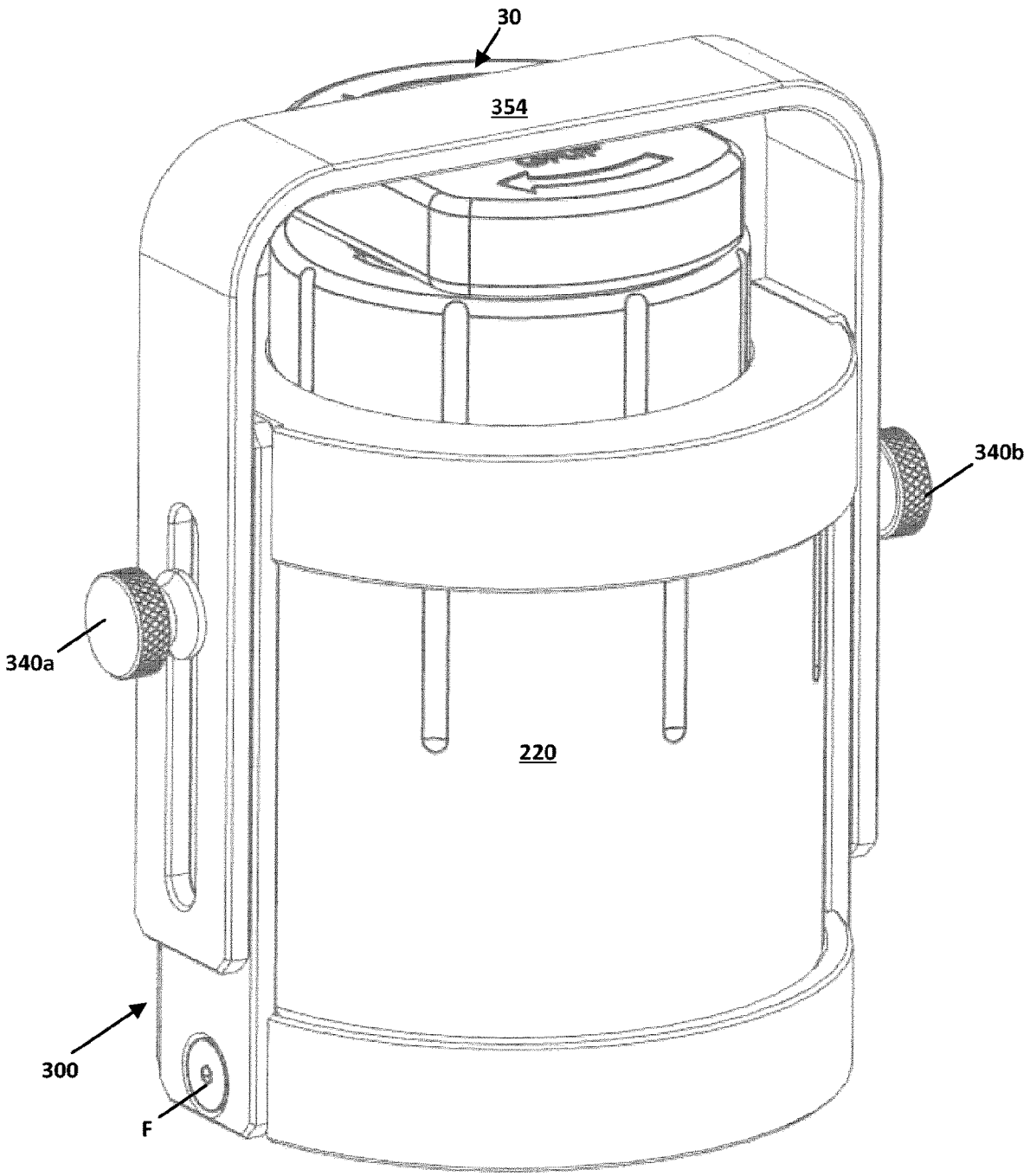
FIG. 15 is a perspective view of the pig and handle assembly of FIG. 14 with the handle assembly in a different orientation.

FIG. 15 is a perspective view of the pig 200 and handle assembly 300 of FIG. 14, with the handle 350 having been slid along knobs 340*a*, 340*b* to a position in which the cross member 354 is resting atop the cap 30 of the pig 200. In this position, the handle 350 serves to further inhibit removal of the cap 30 thereby providing an extra measure of security for transportation. Cap 30 cannot be lifted from body 220 while handle 350 is in this position (and knobs 340*a*, 340*b* are tightened), even if it is rotated somewhat with respect to body 220. In this respect, body 220 can be rotated somewhat within collars 310 and 320 if urged to do so either manually or during jostling in transportation, because, while handle assembly 300 encapsulates body 220, it is not fastened directly to it in this embodiment. The surface of cross member 354 facing the top of cap 30 is generally smooth such that cap 30 is free to rotate along with body 220 even when handle 350 is in the position shown in FIG. 15. In this way, handle 350 is not easily positioned with respect to cap 30 in a way that will result in handle 350 inadvertently loosening cap 30. In an alternative embodiment, body 220 is non-cylindrical such as square-based and handle assembly 300 is of a complementary shape, thus inhibiting any rotation of one with respect to the other.

Figure 16:
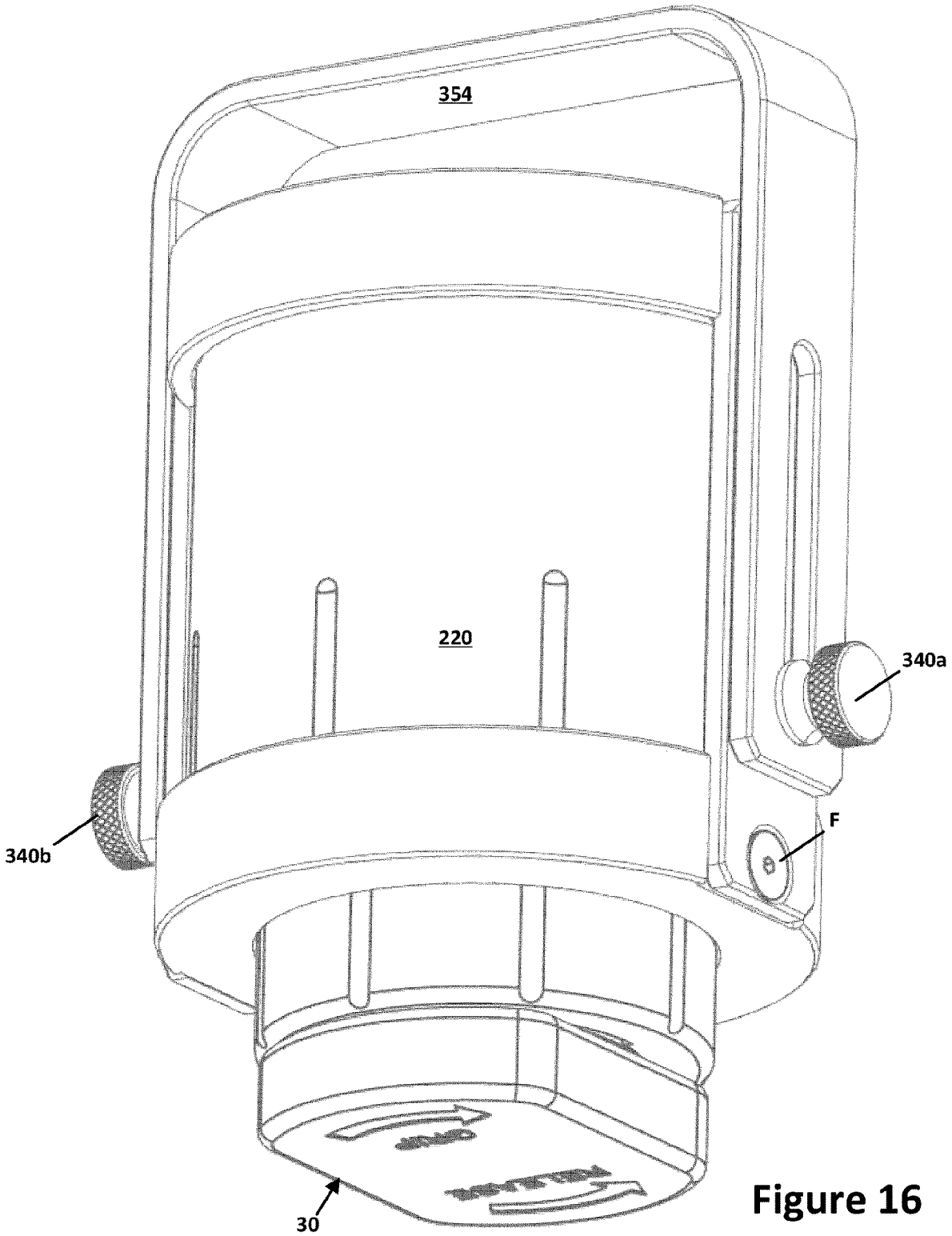
FIG. 16 is another perspective view of the pig and handle assembly of FIG. 14 with the handle assembly in yet a different orientation.

FIG. 16 is a perspective view of the pig 200 and handle assembly 300 of FIG. 14, with the handle 350 having been slid and rotated along knobs 340*a*, 340*b* to a position in which the cross member 354 is underneath and spaced from the bottom of lower collar 320. In this position, handle 350 can be used to hold pig 200 either manually or on a hook (not shown) in preparation for removal of the contents of pig 200.

Figure 17:
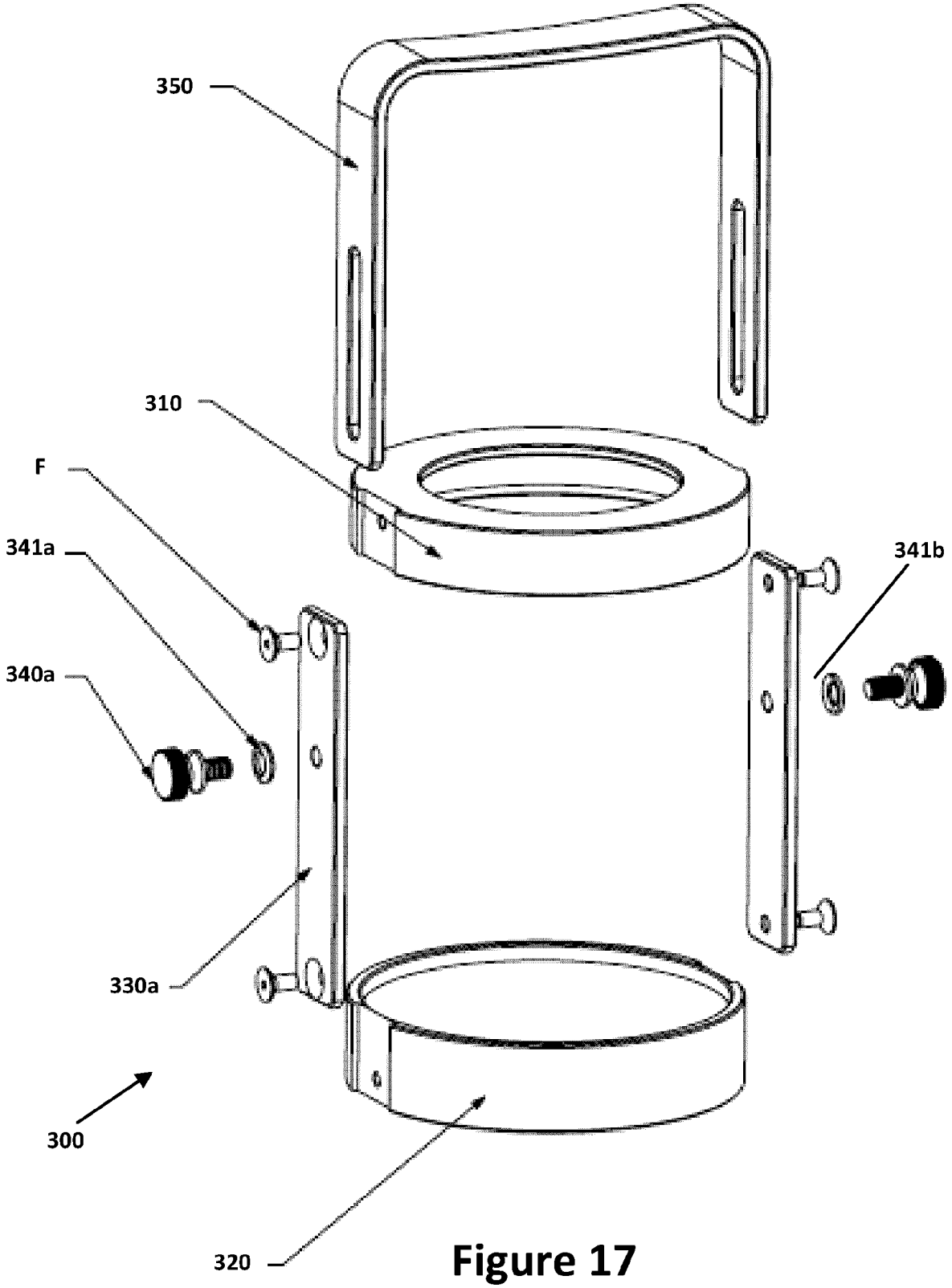
FIG. 17 is an exploded perspective view of the handle assembly for the pig in isolation.

FIG. 17 is an exploded perspective view of the handle assembly 300 for the pig 200 in isolation. In this view, compression washers 341*a* and 341*b*, in this embodiment formed of rubber, are viewable. These are positioned adjacent to the threaded apertures in struts 330*a*, 330*b* for knobs 340*a* and 340*b* in order to improve their grip against handle arms 352*a*, 352*b* via their channels 356*a*, 356*b*, particularly during jostling in transport but also for handling.

Figure 18:
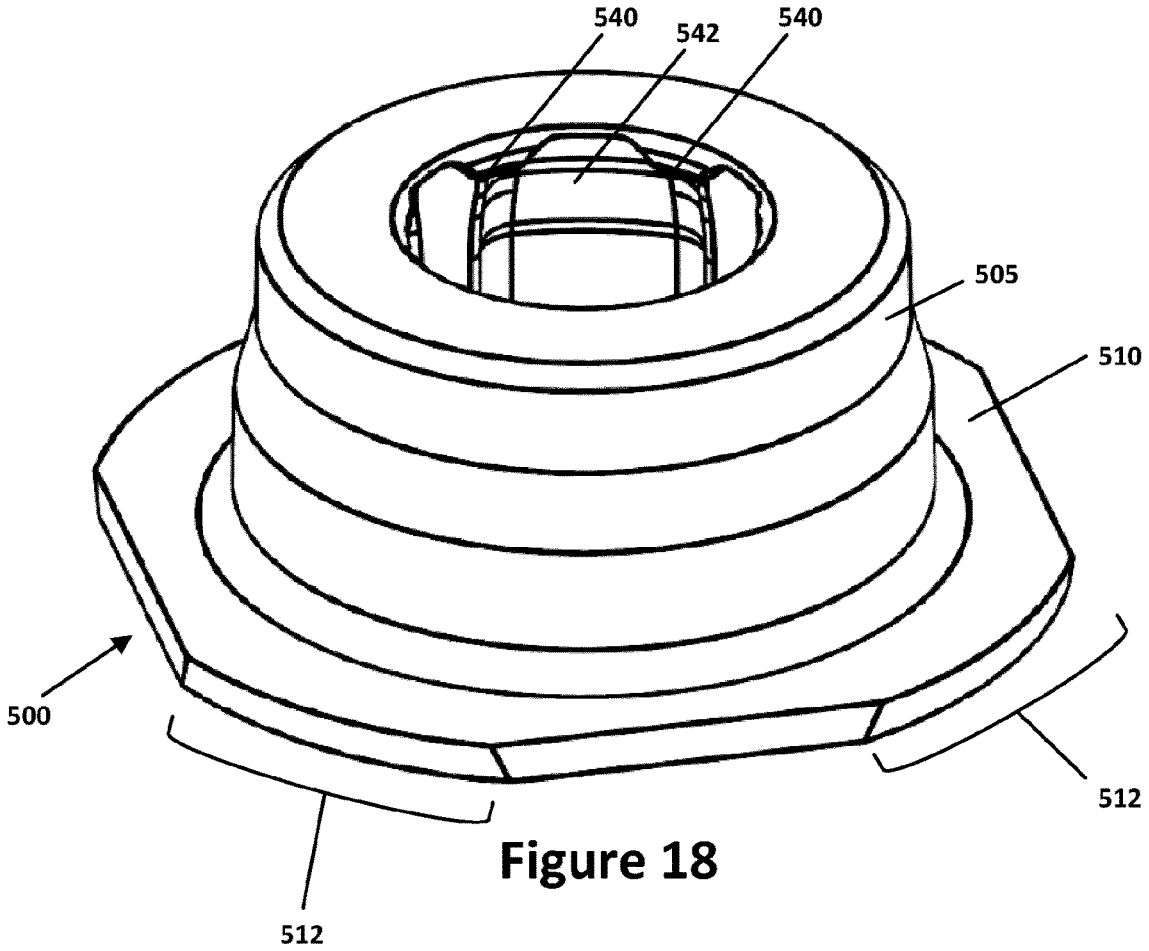
FIG. 18 is a perspective top view of an alternative compression member for assisting in securing the container closure to the cap.

FIG. 18 is a perspective top view of an alternative compression member, or grip 500, for assisting in securing a container closure 14 to the cap 30. In the embodiment shown the grip 500 comprises a flange 510 supporting a sleeve 505 that is integrated with and encompasses spaced apart fingers 540 that form a circle complementary to the inner wall of the annulus 35. The fingers 540 each have a substantially vertical component extending vertically with the sleeve 505 from the flange 510 and a substantially horizontal component extending inwards with the sleeve 505 from the end of the substantially vertical component thereby to overlap the container closure 14 to a degree in a similar manner as has been described above with respect to grip 50. Extending between each pair of fingers 540 of grip 500, however, is a respective web 542 integrated also with sleeve 505 that is made of a material as will be described that permits flexibility of the fingers 540 inwards and outwards and accordingly towards and away from each other, while providing a more unitary overall structure for surrounding a container closure 14.

Figure 19:
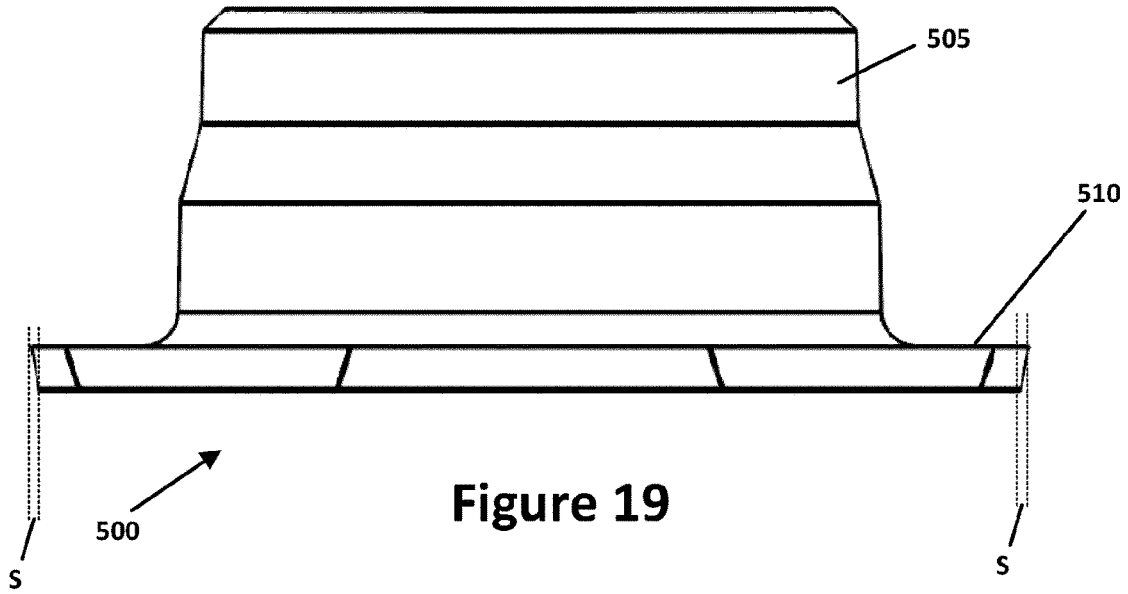
FIG. 19 is a side elevation view of the compression member of FIG. 18.

In this embodiment, flange 510 is formed of a semi-compressible material such as plastic (such as a thermoplastic such as Delrin™ available from Dupont Corporation of Wilmington, Del., U.S.A. or polypropylene). In this embodiment, flange 510 is not circular, but is instead substantially a square with significantly rounded corners 512. Furthermore, flange 510, as best seen in the side elevation view of FIG. 19, has a sloped edge S spanning the entire periphery of the flange 510. Both the rounded corners 512 and the sloped edge S contribute to permit flange 510 to be snapped into, and retained frictionally within, corresponding sloped structure at a correspondingly sloped lower edge of the neck 31 of collar 30*a* of the cap 30. While flange 510 is retained within such a correspondingly sloped lower edge of neck 31, when desired, flange 510 may be manually snapped out of the lower edge of neck 31 of collar 30*a* for disposal of grip 500 and a new grip 500 snapped into place as a replacement. It will be noted that, unlike grip 50, grip 500 does not have posts 52. However, in an alternative embodiment the combination of such posts and the sloped edge S of flange 510 may be employed.

In this embodiment, fingers 540 are formed of the same rigid material as flange 510, while sleeve 505 and webs 542 are formed of a more flexible but resilient material such as silicone that is fused at its boundaries with flange 510 and fingers 540.

While a grip 500 of two integrated materials exhibiting the two different properties (rigid and flexible) can be very useful, it can be expensive to manufacture. As such, in alternative embodiments grip 500 may be manufactured from a single material for the sleeve 505, fingers 540 and webs 542 with the relative rigidity and flexibility produced through differing thicknesses at different points throughout the grip 500 of the one material rather than necessarily from different materials. For example, the interfaces between the webs 542 and the fingers 540 and flange 510 may incorporate less of the material than between the fingers 540 and the flange 510 thereby to permit webs 542 to be flexed relative to the flange 510 and fingers 540 more than the fingers 540 can flex relative to the flange 510. In this way, the resilience of fingers 540 with respect to flange 510 can be maintained while reducing the rigidifying effect of the webs 542 between the fingers 540.

Figure 20:
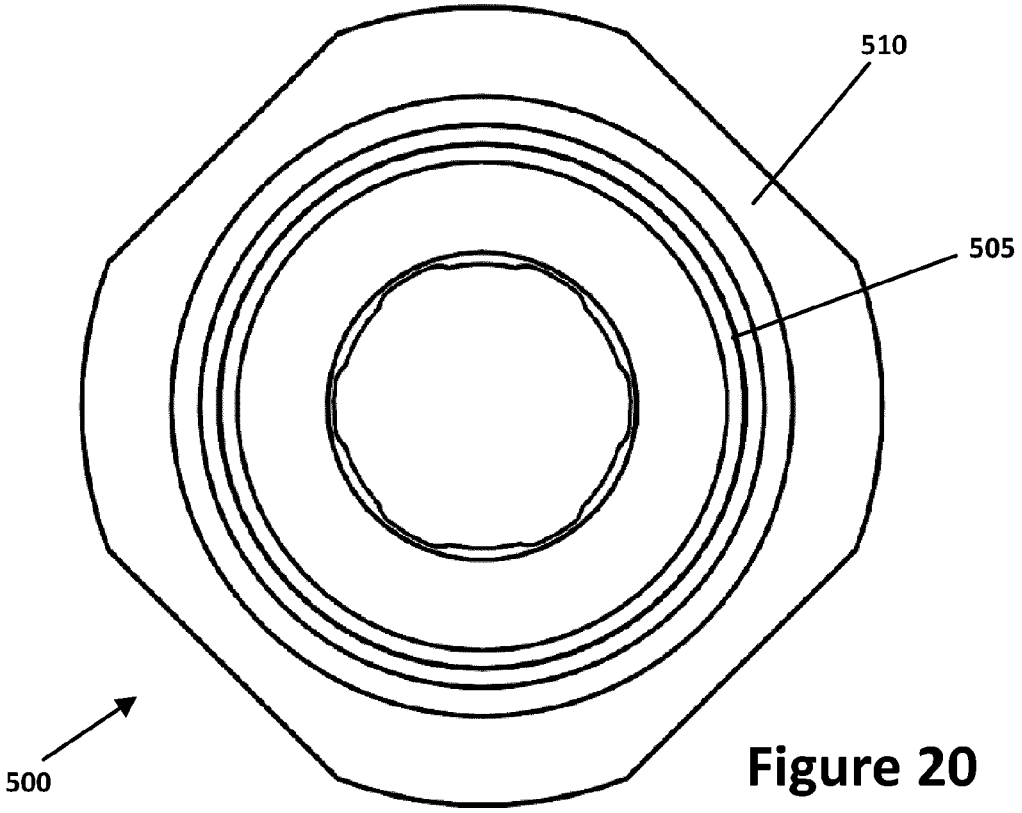
FIG. 20 is a top plan view of the compression member of FIG. 18.
Figure 21:
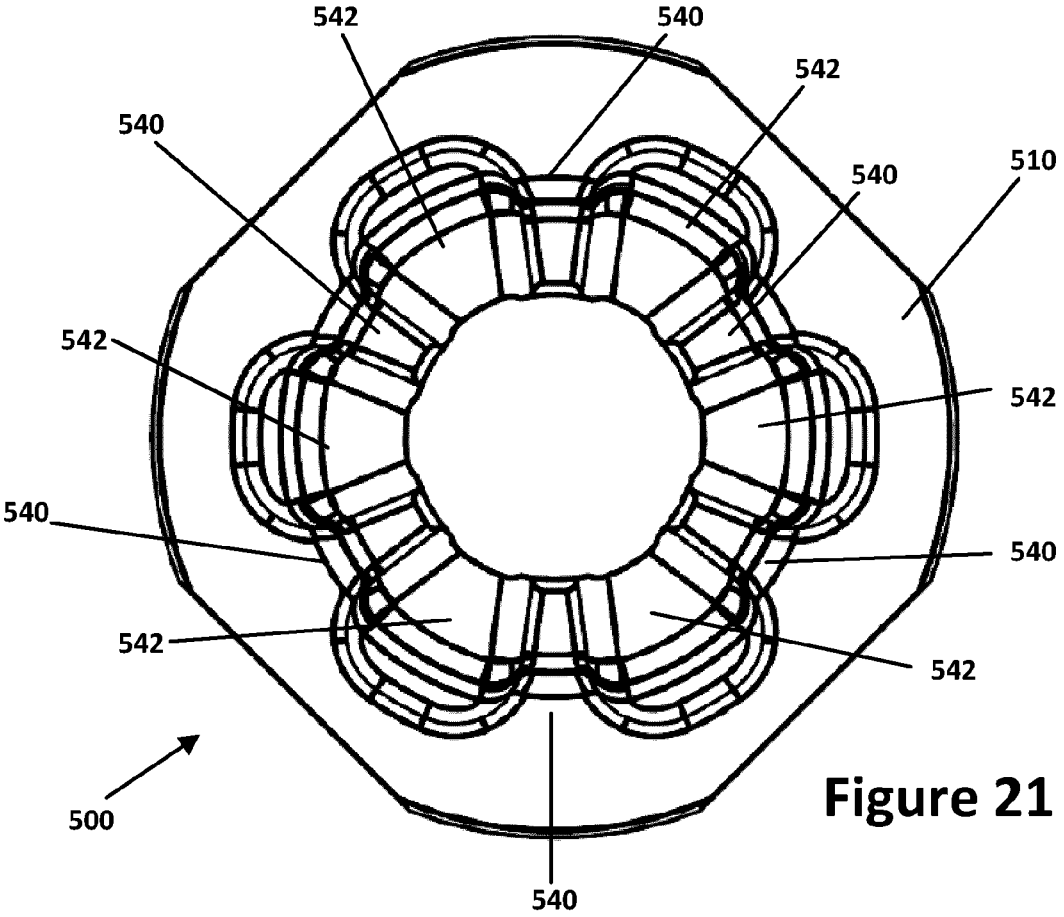
FIG. 21 is a bottom plan view of the compression member of FIG. 18.
Figure 22:
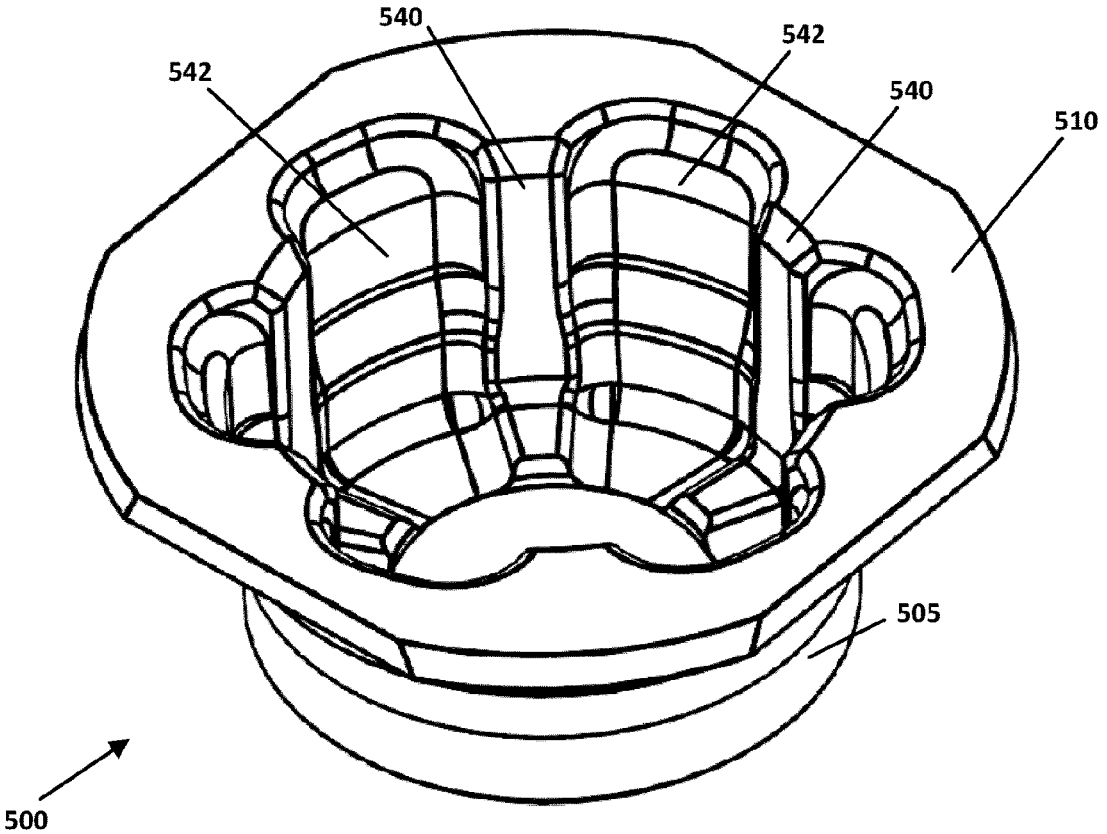
FIG. 22 is a perspective bottom view of the compression member of FIG. 18.
Figure 23:
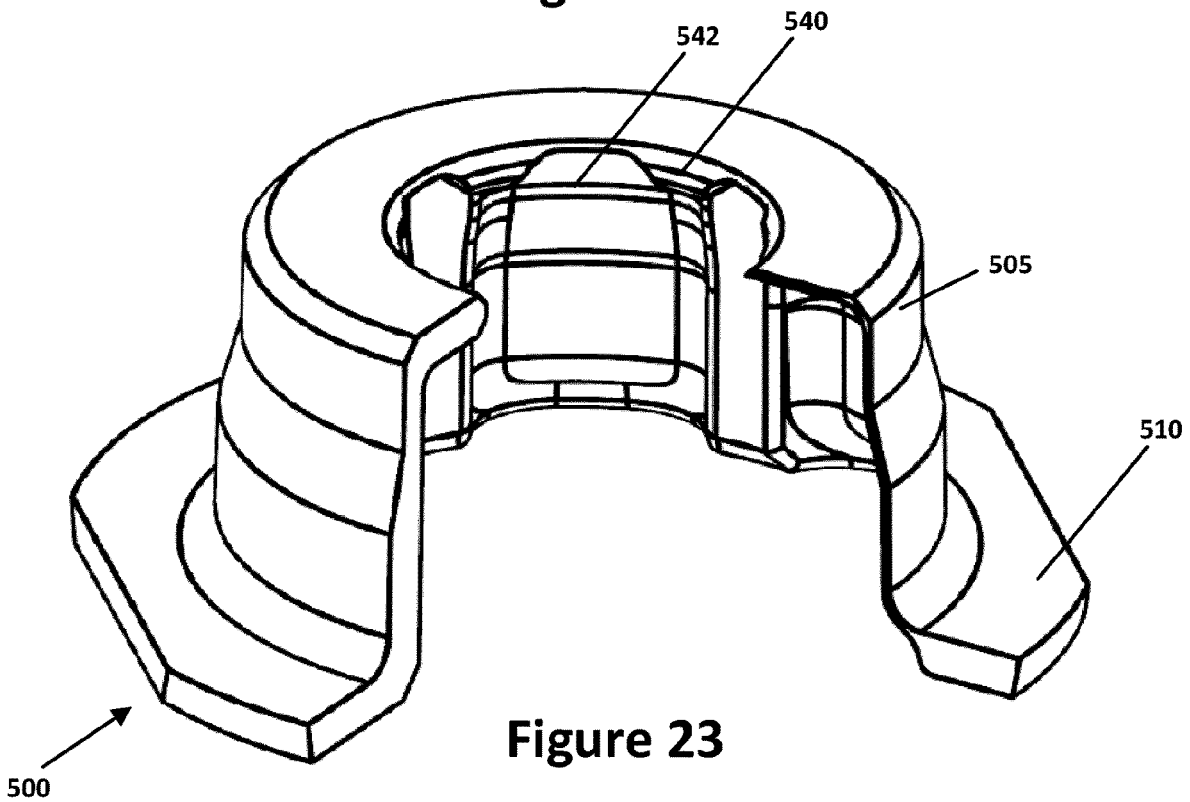
FIG. 23 is a perspective top view, partially sectioned, of the compression member of FIG. 18.
Figure 24:
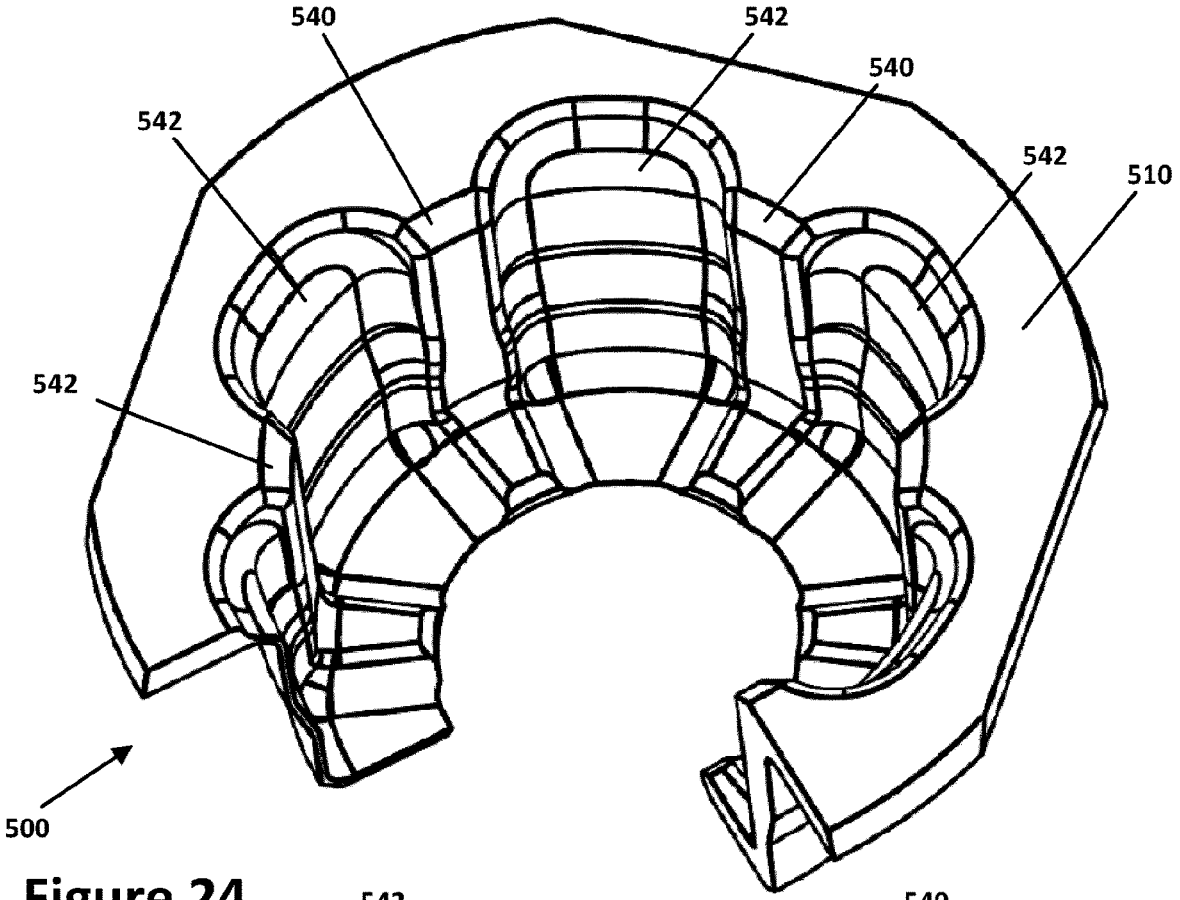
FIG. 24 is a perspective bottom view, partially sectioned, of the compression member of FIG. 18.
Figure 25:
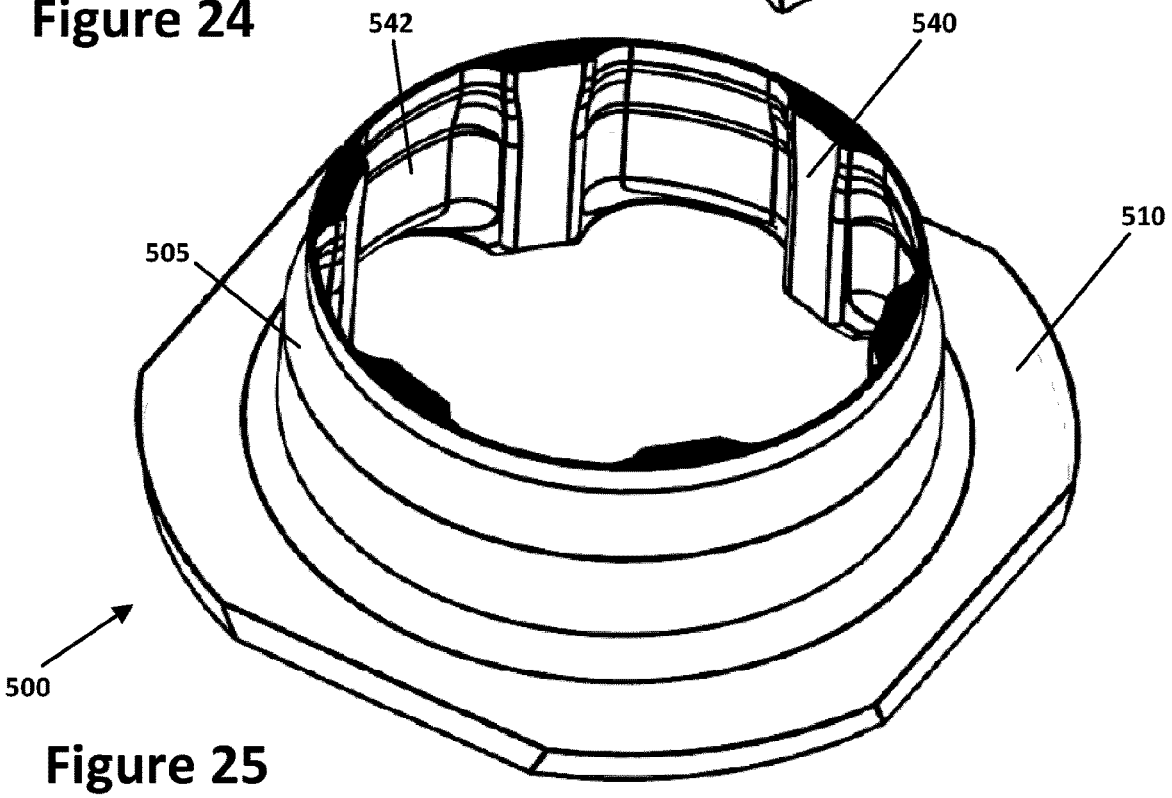
FIG. 25 is another perspective top view, partially sectioned, of the compression member of FIG. 18.
Figure 26:
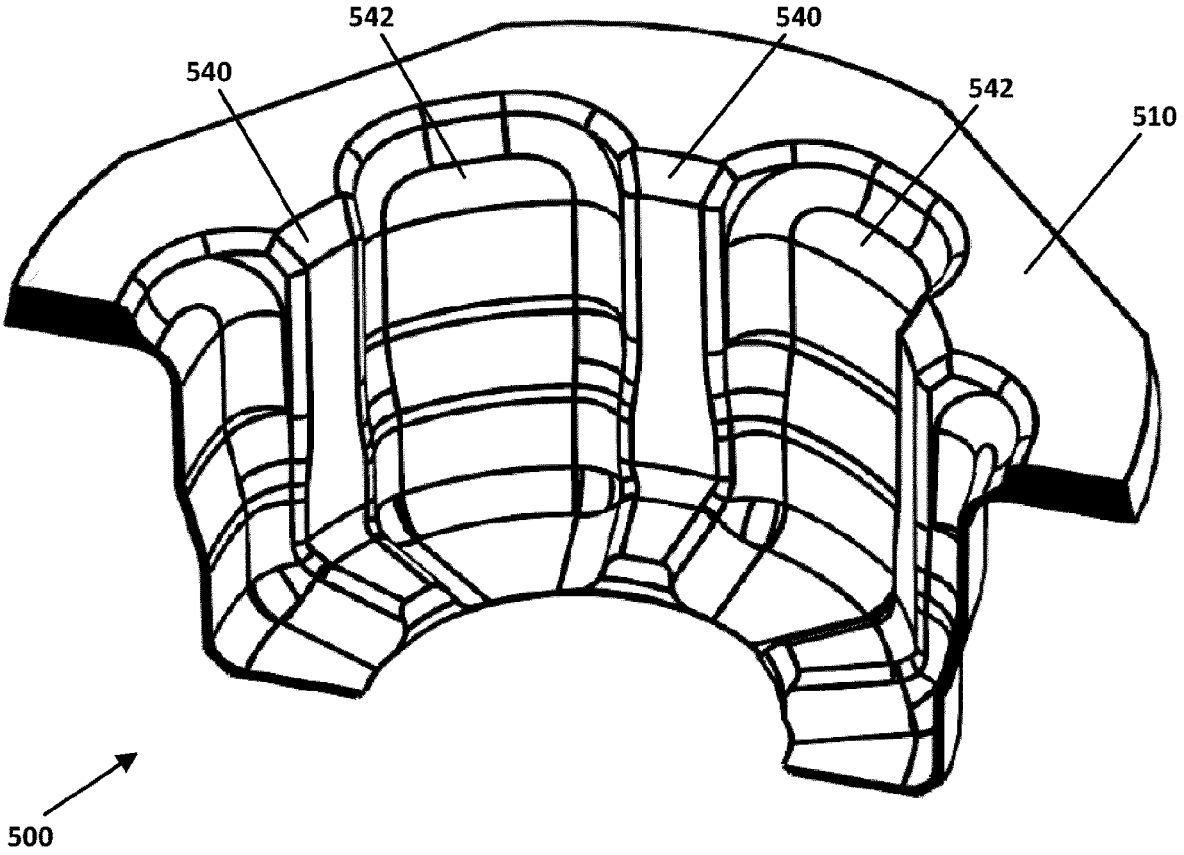
FIG. 26 is another perspective bottom view, partially sectioned, of the compression member of FIG. 18.

FIG. 20 is a top plan view of the grip 500, FIG. 21 is a bottom plan view of the grip 500, FIG. 22 is a perspective bottom view of the grip 500, FIG. 23 is a perspective top view, partially sectioned, of the grip 500, FIG. 24 is a perspective bottom view, partially sectioned, of the grip 500, FIG. 25 is another perspective top view, partially sectioned below the horizontal components of the sleeve 505, the fingers 540 and the webs 542, of the grip 500, FIG. 26 is another perspective bottom view, partially sectioned, of the compression member of FIG. 18.

The radiopharmaceutical pigs 20 and 200 described and illustrated are particularly suitable for transporting radioactive substances such as liquid and solid radiopharmaceuticals due to the radioactivity-shielding character of the container 24, but can be adapted to transport other biohazardous products and materials without the use of radioactivity shielding by hermetically sealing the container 24.

Various embodiments of the present invention comprising been thus described in detail by way of example, it will be apparent to those skilled in the art that variations and modifications may be made without departing from the invention. The invention includes all such variations and modifications as fall within the scope of the appended claims.

For example, while embodiments described herein involve the compartment 24 of body 22 or body 220 being dimensioned to receive only a container of the biohazardous material, embodiments are contemplated in which the compartment 24 is dimensioned to receive a container in addition to a sponge, such as a cellulose sponge, for physically absorbing liquid originally contained within the received container should it escape from the container during transportation or other handling. Some regulators require that there be provided a quantity of sponge that is capable of absorbing twice the volume of liquid to be contained within the container. Such a cellulose sponge may be formed as a slab and positioned at the bottom of compartment 24 underneath the container, but may alternatively be formed as a cup having a bottom and a sleeve dimensioned to receive the container and, in turn, to be received within compartment 24. The cellulose sponge slab or sleeve would be a consumable.

Furthermore, while handle assembly depicted and describe herein has two struts, alternatives are contemplated having more than two struts, or other structures for encapsulating the body within the handle assembly.

Still further, very thin layers of rubber or other frictional material may be placed at the interfaces between collar 30*a* and cap closure 30*b* and collar 30*a* and body 22 in order to resist inadvertent relative movements when being transported to thereby resist inadvertent exposure to the contents of the container 10.

What is claimed is:

1. A pig for transporting a container of biohazardous material, wherein the container comprises a bottle and a bottle closure, the pig comprising:

a body comprising a compartment dimensioned to receive the container;

a cap attachable to the body for closing the compartment thereby to shieldingly contain the biohazardous material in the container, the cap comprising:

a collar sealingly engageable with the body and having an opening therethrough in communication with the compartment thereby to provide access to the bottle closure;

a cap closure sealingly engageable within the opening of the collar to sealingly close the opening and cause the bottle closure to be gripped within the cap, wherein when the collar is disengaged from the body while the cap closure is engaged within the opening of the collar, the container remains gripped within the cap, wherein when the cap closure is released from the opening of the collar, the container is released from the cap.

2. The pig of claim 1, wherein the cap closure comprises an annulus projecting into the opening for causing the bottle closure to be gripped within the cap.

3. The pig of claim 2, further comprising a compression member dimensioned to be positioned intermediate the bottle closure and the annulus, the compression member being compressed against the bottle closure by the annulus while the cap closure is sealingly engaged within the opening of the collar.

4. The pig of claim 3, wherein the compression member comprises:

a flange;

spaced apart fingers supported by the flange and forming a circle complementary to an inner wall of the annulus, the spaced apart fingers resiliently compressible inwardly against the bottle closure by compressive engagement of the annulus.

5. The pig of claim 4, wherein the compression member comprises lugs extending from the flange and dimensioned to project into complementary bores in a lower edge of the collar.

6. The pig of claim 5, wherein the compression member is formed of a thermoplastic.

7. The pig of claim 1, further comprising a handle assembly encapsulating the body and comprising a handle that is extendable and rotatable through a plurality of orientations with respect to the body.

8. The pig of claim 7, wherein the handle assembly comprises:

an upper collar associated with an upper end of the body;

a lower collar associated with a lower end of the body;

at least two struts extending between the upper collar and the lower collar thereby to maintain the upper collar and the lower collar in a fixed spaced relationship, the handle associated with and extending from the struts.

9. The pig of claim 8, wherein the handle comprises:

two elongate arms depending from opposite ends of a cross member, each of the arms having an elongate channel therethrough, wherein each elongate channel is dimensioned to rotate and slide with respect to a respective knob being passed through each channel into a respective aperture in a corresponding strut while the knob is untightened to its respective aperture, wherein the handle is fixed in position with respect to the body while at least one of the knobs is tightened within its respective aperture.

10. The pig of claim 8, wherein at least the upper collar and the lower collar are formed from a thermoplastic material.

11. A system for transporting and providing access to a biohazardous material, the system comprising:

a pig for transporting a container of biohazardous material, wherein the container comprises a bottle and a bottle closure, the pig comprising:

a body comprising a compartment dimensioned to receive the container;

a cap attachable to the body for closing the compartment thereby to shieldingly contain the biohazardous material in the container, the cap comprising:

a collar sealingly engageable with the body and having an opening therethrough in communication with the compartment thereby to provide access to the bottle closure;

a cap closure sealingly engageable within the opening of the collar to sealingly close the opening and cause the bottle closure to be gripped within the cap, wherein when the collar is disengaged from the body while the cap closure is engaged within the opening of the collar, the container remains gripped within the cap;

wherein when the cap closure is released from the opening of the collar, the container is released from the cap; and an insert sealingly engageable within the opening of the collar while the cap closure is removed, the insert comprising an injection port extending fully therethrough in axial alignment with the compartment thereby to guide insertion of a syringe centrally through the container closure and into the container.

12. The system of claim 11, wherein the injection port is cylindrical and has a single diameter extending fully through the insert.

13. The system of claim 11, wherein the injection port has an upper portion extending partway through the insert and having a first diameter, and a lower portion extending from the upper portion through the rest of the insert and having a second diameter, the second diameter being smaller than the first diameter.

14. A compression member for insertion into a pig for transporting a container of biohazardous materials, the compression member comprising:

a flange; and spaced apart fingers supported by the flange and together forming a circle, the fingers each having a substantially vertical component connected to and extending upwards from the flange and a substantially horizontal component connected to, and extending inwards towards the middle of the circle from, an end of the substantially vertical component that is distal from the flange, wherein spaced apart fingers are resiliently compressible inwardly towards the middle of the circle against the container by compressive engagement of a complementary annulus of the pig into which the compression member is dimensioned to be inserted.

15. The compression member of claim 14, wherein the compression member comprises lugs extending from the flange for frictional retention within the complementary annulus.

16. The compression member of claim 14 wherein the flange and fingers are formed of a thermoplastic material.

17. The compression member of claim 14, further comprising a web extending between each pair of adjacent fingers.

18. The compression member of claim 17, wherein the flange and fingers are formed from a first material and each web is formed from a second material that is less rigid than the first material.

19. The compression member of claim 18, wherein the first material is a thermoplastic and the second material is silicone.

20. The compression member of claim 14, wherein the flange comprises a sloped edge about its periphery for snap retention within the complementary annulus.

* * * * *